US011345558B2

(12) United States Patent
Egawa et al.

(10) Patent No.: US 11,345,558 B2
(45) Date of Patent: May 31, 2022

(54) SHEET CONVEYING DEVICE, IMAGE FORMING APPARATUS INCORPORATING THE SHEET CONVEYING DEVICE, METHOD OF CONVEYING CONVEYANCE TARGET MEDIUM, AND METHOD OF FORMING IMAGE ON CONVEYANCE TARGET MEDIUM USING THE METHOD OF FORMING IMAGE

(71) Applicants: Tomohiro Egawa, Kanagawa (JP); Yuichiro Maeyama, Kanagawa (JP); Motoharu Takahashi, Kanagawa (JP)

(72) Inventors: Tomohiro Egawa, Kanagawa (JP); Yuichiro Maeyama, Kanagawa (JP); Motoharu Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/204,013

(22) Filed: Nov. 29, 2018

(65) Prior Publication Data

US 2019/0161299 A1 May 30, 2019

(30) Foreign Application Priority Data

Nov. 30, 2017 (JP) ..... JP2017-230434
Nov. 20, 2018 (JP) ..... JP2018-217148

(51) Int. Cl.
*B65H 7/14* (2006.01)
*B65H 7/10* (2006.01)
(Continued)

(52) U.S. Cl.
CPC ..... *B65H 7/14* (2013.01); *B65H 7/10* (2013.01); *B65H 9/002* (2013.01); *B65H 9/20* (2013.01);
(Continued)

(58) Field of Classification Search
CPC .... B65H 7/14; B65H 9/002; B65H 2301/331; B65H 2513/108; B65H 2404/1424;
(Continued)

(56) References Cited

U.S. PATENT DOCUMENTS 4,733,281 A * 3/1988 Yoshinaga ..... G03G 15/5012 399/18
7,195,238 B2 * 3/2007 Suga ..... B65H 9/002 271/227
(Continued)

FOREIGN PATENT DOCUMENTS

JP 6-234441 8/1994
JP 9-175694 7/1997
(Continued)

*Primary Examiner* — Patrick Cicchino
(74) *Attorney, Agent, or Firm* — Harness, Dickey & Pierce, P.L.C.

(57) ABSTRACT

A sheet conveying device includable in an image forming apparatus that uses a method of conveying a conveyance target medium and a method of forming an image, includes a position detector, a position adjuster, and circuitry. The position detector is configured to detect a position of a conveyance target medium. Based on a detection of the position of the conveyance target medium by the position detector, the position adjuster moves in at least one of a width direction of the conveyance target medium and a rotation direction of the conveyance target medium within a plane of conveyance of the conveyance target medium and repeatedly adjusts the position of the conveyance target medium while conveying the conveyance target medium. The circuitry changes a conveying speed of the conveyance target medium, according to a change of the position of the conveyance target medium after adjusted by the position adjuster.

30 Claims, 24 Drawing Sheets

(51) Int. Cl.
*B65H 9/00* (2006.01)
*B65H 9/20* (2006.01)
*G03G 15/00* (2006.01)

(52) U.S. Cl.
CPC ... *G03G 15/6561* (2013.01); *B65H 2301/331* (2013.01); *B65H 2404/1424* (2013.01); *B65H 2404/14212* (2013.01); *B65H 2513/108* (2013.01); *B65H 2553/416* (2013.01); *B65H 2601/272* (2013.01); *B65H 2701/1912* (2013.01); *B65H 2801/27* (2013.01)

(58) Field of Classification Search
CPC .... B65H 2404/14212; B65H 2553/416; B65H 2601/272
See application file for complete search history.

(56) References Cited

U.S. PATENT DOCUMENTS 7,472,905 B2 * 1/2009 Inoue ..... B65H 9/006 271/227
8,328,188 B2 * 12/2012 Mandel ..... B65H 9/002 271/228
8,376,357 B2 * 2/2013 Tharayil ..... B65H 9/002 271/228
9,637,338 B2 * 5/2017 Nakai ..... B65H 7/10
9,776,819 B2 * 10/2017 Yamane ..... B65H 9/002
2007/0075483 A1 * 4/2007 Katayama ..... B65H 9/002 271/242
2016/0159598 A1 * 6/2016 Yamane ..... B65H 9/002 271/227
2018/0194581 A1 * 7/2018 Matsumoto ..... B65H 7/14

FOREIGN PATENT DOCUMENTS

JP 10-067448 3/1998
JP 10-120253 5/1998
JP 2003-302845 10/2003
JP 2005-041603 2/2005
JP 2005-041604 2/2005
JP 2005-053646 3/2005
JP 2005-178929 7/2005
JP 2006-027859 2/2006
JP 2007-022806 2/2007
JP 2010-149377 7/2010
JP 2011-098790 5/2011
JP 2014-088263 5/2014
JP 2014-193769 10/2014
JP 2016-024546 2/2016
JP 2016-044067 4/2016
JP 2016-108152 6/2016
JP 5959912 B2 * 8/2016
JP 2016-175776 10/2016
JP 2016-188142 11/2016
JP 2017-088265 5/2017
JP 2017-202916 11/2017

* cited by examiner

SHEET CONVEYING DEVICE, IMAGE FORMING APPARATUS INCORPORATING THE SHEET CONVEYING DEVICE, METHOD OF CONVEYING CONVEYANCE TARGET MEDIUM, AND METHOD OF FORMING IMAGE ON CONVEYANCE TARGET MEDIUM USING THE METHOD OF FORMING IMAGE

CROSS-REFERENCE TO RELATED APPLICATIONS

This patent application is based on and claims priority pursuant to 35 U.S.C. § 119(a) to Japanese Patent Application Nos. 2017-230434, filed on Nov. 30, 2017, and 2018-217148, filed on Nov. 20, 2018, in the Japan Patent Office, the entire disclosure of each of which is hereby incorporated by reference herein.

BACKGROUND

Technical Field

This disclosure relates to a sheet conveying device that feeds a conveyance target medium, an image forming apparatus including the sheet conveying device, a method of conveying a conveyance target medium, and a method of forming an image on a conveyance target medium using the method of conveying the conveyance target medium.

Related Art

Various sheet conveying devices that convey a conveyance target medium are known to convey sheets such as papers and original documents in an image forming apparatus such as a copier and a printer.

In general, such sheet conveying devices are known that, when a sheet is conveyed to an image forming device or an image transfer device, the sheet under conveyance is abutted against a nip region of a pair of sheet conveying rollers that is stopped so as to correct an angular displacement of the sheet, and then the pair of sheet conveying rollers starts rotating at a predetermined timing to convey the sheet to a target position. However, a method of abutting the sheet to the nip region of the pair of sheet conveying rollers causes the sheet to stop temporarily, and therefore the productivity degrades (the image forming speed decreases).

In order to address this inconvenience and correct positional deviations of a sheet without degrading the productivity, a known sheet conveying device has been proposed that a pair of rollers is driven in a direction opposite to the direction of a positional deviation of the sheet while conveying the sheet so that the positional deviation of the sheet is corrected without stopping conveyance of the sheet.

However, when the positional deviation of a sheet is corrected while the sheet is being conveyed, the position of the leading end of the sheet changes, and therefore an amount of time that the leading end of the sheet reaches a predetermined target position varies. Consequently, if the sheet is conveyed at a predetermined conveying speed, the timing at which the sheet reaches the target position is shifted, which causes an inconvenience that the sheet cannot be conveyed with high accuracy.

In order to solve the shift of the timing caused by the correction of the positional deviation of the sheet, the known sheet conveying device calculates the position of the leading end of the sheet after the correction of the positional deviation of the sheet based on the positional deviation amount of the sheet, and the sheet conveying speed is adjusted based on the calculation result.

However, the known sheet conveying device detects the angular displacement of the sheet for one time, and therefore the correction of the angular and lateral displacements of the sheet is also performed for one time. Consequently, when the sheet further shifts after the correction of the positional deviation of the sheet the known sheet conveying device cannot convey the sheet with high accuracy.

SUMMARY

At least one aspect of this disclosure provides a sheet conveying device including a position detector, a position adjuster, and circuitry. The position detector is configured to detect a position of a side end of a conveyance target medium. The position adjuster is configured to, based on a detection of the position of the side end of the conveyance target medium detected by the position detector, move in at least one of a width direction of the conveyance target medium and a rotation direction of the conveyance target medium within a plane of conveyance of the conveyance target medium and repeatedly adjust the position of the side end of the conveyance target medium, while the conveyance target medium is being conveyed. The circuitry is configured to change a conveying speed of the conveyance target medium, according to a change of the position of the side end of the conveyance target medium after adjusted by the position adjuster.

Further, at least one aspect of this disclosure provides an image forming apparatus including the above-described sheet conveying device.

Further, at least one aspect of this disclosure provides a sheet conveying device including a plurality of position sensors, a position adjuster, and circuitry. The plurality of position sensors are configured to detect a position of a side end of a conveyance target medium. The position adjuster is configured to, based on a detection of the position of the side end of the conveyance target medium detected by the plurality of position sensors, move in at least one of a width direction of the conveyance target medium and a rotation direction of the conveyance target medium within a plane of conveyance of the conveyance target medium and adjust the position of the side end of the conveyance target medium, while the conveyance target medium is being conveyed. The circuitry is configured to change a conveying speed of the conveyance target medium, according to a change of the position of the side end of the conveyance target medium after adjusted by the position adjuster.

Further, at least one aspect of this disclosure provides an image forming apparatus including the above-described sheet conveying device.

Further, at least one aspect of this disclosure provides a method of conveying a conveyance target medium including detecting a position of a side end of a conveyance target medium, moving in at least one of a width direction of the conveyance target medium and a rotation direction of the conveyance target medium within a plane of conveyance of the conveyance target medium while the conveyance target medium is being conveyed, based on a detection of the position of the conveyance target medium, adjusting the position of the side end of the conveyance target medium repeatedly while the conveyance target medium is being conveyed, based on the detection of the position of the conveyance target medium, and changing a conveying speed of the conveyance target medium, according to a change of the position of the side end of the conveyance target medium after adjusted by the adjusting.

Further, at least one aspect of this disclosure provides a method of forming an image on a conveyance target medium using the above-described method of conveying the conveyance target medium to convey the conveyance target medium and form an image on the conveyance target medium.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
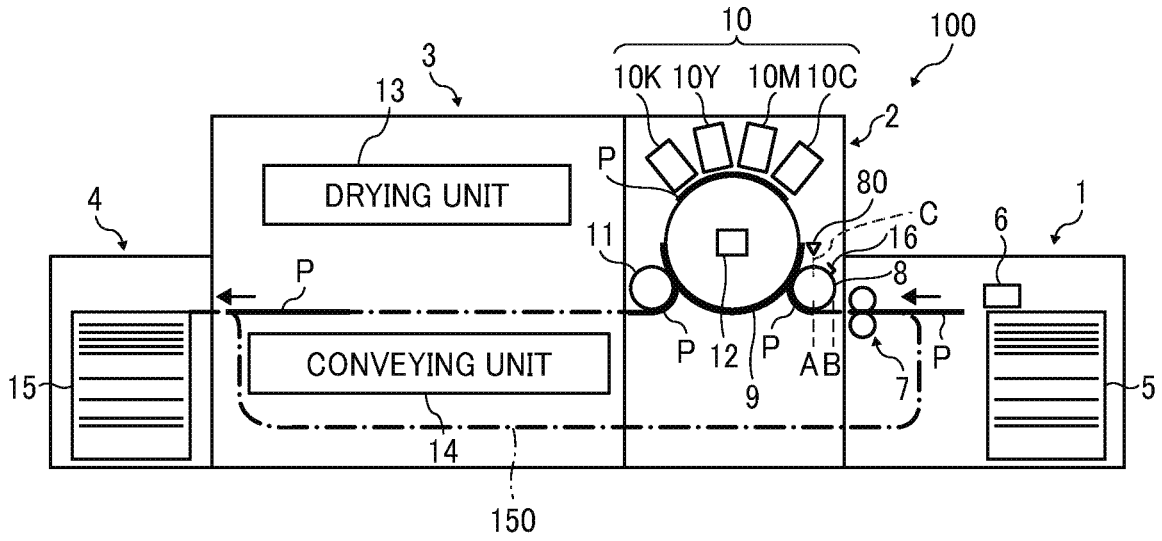
FIG. 1 is a diagram illustrating a schematic configuration of an inkjet image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device and an image forming apparatus incorporating the sheet conveying device.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an inkjet age forming apparatus 100 according to an embodiment of this disclosure.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an inkjet printer that forms toner images on recording media with ink.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet. The term "sheet" also functions as a conveyance target medium.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Overall Configuration.

The inkjet type image forming apparatus 100 according to the present embodiment mainly includes a sheet feeding device 1, an image forming device 2, a drying device 3, and a sheet output device 4. In the inkjet type image forming apparatus 100, an image is formed by ink, which is a liquid for image formation, in the image forming device 2 on a sheet P as a sheet supplied from the sheet feeding device 1. Then, after the ink adhered on the sheet P is dried in the drying device 3, the sheet P is discharged from the sheet output device 4.

Further, when performing a duplex printing operation, after the image is formed on the front face of the sheet P in the image forming device 2, the sheet is dried by the drying device 3, and the sheet P is not discharged but is conveyed to a sheet reverse and conveyance passage 150. By passing through the sheet reverse and conveyance passage 150, the sheet P is reversed in the sheet reverse and conveyance passage 150 and conveyed to the image forming device 2 again. After an image is formed on a back face of the sheet P in the image forming device 2, the sheet P is dried in the drying device 3 and is discharged from the sheet output device 4.

Sheet Feeding Device.

The sheet feeding device 1 mainly includes a sheet feed tray 5, a sheet feeder 6 and a sheet conveying device 7. The sheet feed tray 5 is a sheet loader on which multiple sheets P are loaded thereon. The sheet feeder 6 separates and feeds the multiple sheets P one by one from the sheet feed tray 5. The sheet conveying device 7 conveys the sheet P to the image forming device 2. The sheet feeder 6 may be a sheet feeding unit that includes rollers, a sheet feeding unit employing an air suction method, and any other sheet feeding units. The sheet P fed from the sheet feed tray 5 by the sheet feeder 6 is conveyed to the image forming device 2 by the sheet conveying device 7.

Image Forming Device.

The image forming device 2 mainly includes a transfer cylinder 8, a sheet holding drum 9, an ink discharging device 10 and a transfer cylinder 11. The transfer cylinder 8 functions as a first conveyance rotary body to receive and transfer the fed sheet P to the sheet holding drum 9. The sheet holding drum 9 functions as a second conveyance rotary body to hold (grip) and convey the sheet P conveyed by the transfer cylinder 8 on an outer circumferential surface thereof. The ink discharging device 10 discharges ink toward the sheet P held by the sheet holding drum 9. The transfer cylinder 11 functions as a third conveyance rotary body to transfer the sheet P conveyed by the sheet holding drum 9 to the drying device 3.

After the sheet P is conveyed from the sheet feeding device 1 to the image forming device 2, a gripper 16 that is rotatable as a handle mounted on a surface of the transfer cylinder 8 grips the leading end of the sheet P, so that the sheet P is conveyed along with the surface movement of the transfer cylinder 8. The sheet P conveyed by the transfer cylinder 8 is transferred to the sheet holding drum 9 at an opposing position where the sheet P is brought to face the sheet holding drum 9.

A gripper similar to the gripper 16 on the transfer cylinder 8 is provided on the surface of the sheet holding drum 9, so that the leading end of the sheet P is gripped by the gripper on the sheet holding drum 9. Multiple air drawing openings are dispersedly formed on the surface of the sheet holding drum 9, and a suction airflow directing toward the inside of the sheet holding drum 9 by an air drawing device 12 is generated at each air drawing opening. The leading end of the sheet P that is transferred from the transfer cylinder 8 to the sheet holding drum 9 is gripped by the gripper. At the same time, the sheet P is sucked on the surface of the sheet holding drum 9 due to the suction airflow and is conveyed along with the surface movement of the sheet holding drum 9.

The ink discharging device 10 according to the present embodiment includes liquid discharging heads 10C, 10M, 10Y and 10K having different colors of C (cyan), M (magenta), Y (yellow), and K (black), respectively, to form an image. The configuration of the liquid discharging heads 10C, 10M, 10Y and 10K is not limited thereto and any other configuration may be applied as long as each liquid discharging head ejects liquid. Another liquid discharging head that ejects special ink such as white, gold and silver may be added to the ink discharging device 10 or yet another liquid discharging head that ejects a surface coating liquid that does not form an image may be provided to the ink discharging device 10.

Respective discharging operations of the liquid discharging heads 10C, 10M, 10Y and 10K of the ink discharging device 10 are individually controlled by respective drive signals according to image data. When a sheet P held by the sheet holding drum 9 passes by an opposing region facing the ink discharging device 10, respective color inks are discharged from the liquid discharging heads 10C, 10M, 10Y and 10K, so that an image is formed according to the image data. It is to be noted that, in the present embodiment, the image forming device 2 is not limited thereto and any other configuration may be applied as long as the configuration is to form an image by supplying and adhering liquid onto the sheet P.

Drying Device.

The drying device 3 mainly includes a drying unit 13 and a sheet conveying unit 14. The drying unit 13 dries ink that is adhered on the sheet P in the image forming device 2. The sheet conveying unit 14 coveys the sheet P that is conveyed from the image forming device 2. The sheet P conveyed from the image forming device 2 is received by the sheet conveying unit 14. Then, the sheet P is conveyed to pass by the drying unit 13 and is transferred to the sheet output device 4. When passing through the drying unit 13, the ink on the sheet P is subjected to a drying process. By so doing, the liquid content such as moisture in the ink is evaporated, and therefore the ink is fixed onto the sheet P and curling of the sheet P is restrained.

Sheet Output Device.

The sheet output device 4 mainly includes a sheet output tray 15 onto which multiple sheets P are output and stacked. The sheets P that are sequentially conveyed from the drying device 3 are overlaid one after another and stacked. It is to be noted that the configuration of the sheet output device 4 according to the present embodiment is not limited thereto and any other configuration may be applied as long as the sheet output device discharges the sheet P or the multiple sheets P.

Other Additional Functional Devices.

As described above, the inkjet type image forming apparatus 100 according to the present embodiment includes the sheet feeding device 1, the image forming device 2, the drying device 3 and the sheet output device 4. However, other functional devices may be added appropriately. For example, the inkjet type image forming apparatus 100 may further include a pre-processing device between the sheet feeding device 1 and the image forming device 2 to perform pre-processing operations of image formation. The inkjet type image forming apparatus 100 may further include a post-processing device between the drying device 3 and the sheet output device 4 to perform post-processing operations of image formation.

An example of the pre-pre-processing device performs a processing liquid applying operation to apply processing liquid onto the sheet P so as to reduce bleeding by reacting with ink. However, the content of the pre-processing operation is not limited particularly. Further, an example of the post-processing device performs sheet reversing and conveying operations in the sheet reverse and conveyance passage 150 to reverse the sheet P having an image formed thereon in the image forming device 2 and convey the sheet P to the image forming device 2 again to form images on both sides of the sheet P or performs a binding operation to bind the multiple sheets P having respective images thereon. However, the content of the post-processing operation is not limited particularly.

It is to be noted that the term "image" to be formed on a sheet is not limited to visible significant images such as texts and figures but includes, for example, patterns that themselves have no meaning. In addition, the term "sheet" on which the image is formed is not limited to limited materials but may include any object to which liquid can be temporarily attached, for example, paper, thread, fiber, cloth, leather, metal, plastic, glass, wood and ceramics, or any object to be used for film products, cloth products such as clothing, building materials such as wallpaper and flooring materials and leather products, and functions as a conveyance target medium. The term "liquid" is not particularly limited as long as the liquid has a viscosity and a surface tension that can be discharged from the liquid discharging head. However, but it is preferable that the liquid has a viscosity of 30 mPa·s or less at normal temperature and normal pressure or by heating and cooling. More specifically, the liquid includes a solvent such as water or an organic solvent, a solution including a coloring agent such as a dye or a pigment, a functionalizing material such as a polymerizable compound, a resin or a surfactant, a biocompatible material such as DNA, amino acid, protein or calcium, edible materials such as natural pigments, or suspension or emulsion. These liquids can be used for ink for inkjet printing and surface treatment liquid, for example.

In addition, the term "inkjet type image forming apparatus" indicates an apparatus in which liquid discharging head(s) and a sheet material move relatively but is not limited thereto. An example of the inkjet type image forming apparatus includes a serial type image forming apparatus in which the liquid discharging head moves and a line type image forming apparatus in which the liquid discharging head does not move.

Further, the term "liquid discharging head" indicates a functional component that discharges and ejects liquid from liquid discharging holes (nozzles). As an energy generation source for discharging liquid, a discharging energy generating device, e.g., a piezoelectric actuator (stacked piezoelectric element and thin film piezoelectric element), a thermal actuator using an electrothermal transducer such as a heating resistor, and an electrostatic actuator including a diaphragm and a counter electrode, can be used. However, the discharging energy generating device to be used is not limited.

Next, a description is given of the sheet conveying device 7 included in the sheet feeding device 1 of the inkjet type image forming apparatus 100 according to the present embodiment of this disclosure.

Figure 2:
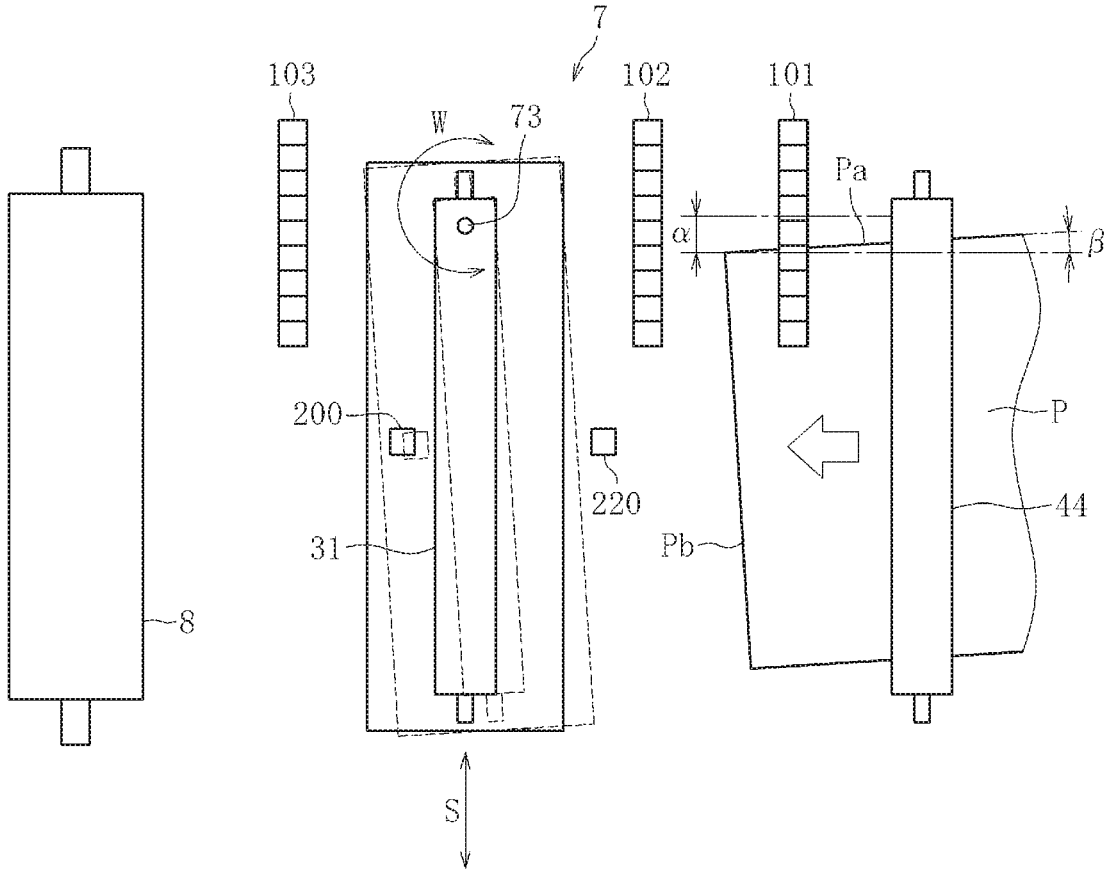
FIG. 2 is a diagram illustrating a sheet conveying device according to the present embodiment of this disclosure.

FIG. 2 is a diagram illustrating the sheet conveying device 7 according to the present embodiment of this disclosure.

As illustrated in FIG. 2, the sheet conveying device 7 includes three CISs, which are the first CIS 101, the second CIS 102 and the third CIS 103, two leading end detection sensors, which are a downstream side leading end detection sensor 200 and an upstream side leading end detection sensor 220, and the pair of sheet holding rollers 31. The first CIS 101, the second CIS 102 and the third CIS 103 function as a position detector or occasionally a plurality of position sensors as a group to detect the position of the sheet P. Both the downstream side leading end detection sensor 200 and the upstream side leading end detection sensor 220 function as sheet conveyance timing detectors to detect a sheet conveyance timing of the sheet P. The pair of sheet holding rollers 31 functions as a position adjuster to change the position of the sheet P while holding (gripping) the sheet P under conveyance. In the following description, the first CIS 101 that functions as a first position detector or occasionally a position sensor of a plurality of position sensors, the second. CIS 102 that functions as a second position detector or occasionally a position sensor of a plurality of position sensors, and the third CIS 103 that functions as a third position detector or occasionally a position sensor of a plurality of position sensors are disposed from an upstream side to a downstream side of the sheet conveying direction of the sheet P. Further, the downstream side leading end detection sensor 200 is disposed downstream from the pair of sheet holding rollers 31 in the sheet conveying direction and functions as a first sheet conveyance timing detector. The upstream side leading end detection sensor 220 is disposed upstream from the pair of sheet holding rollers 31 in the sheet conveying direction functions as a second sheet conveyance timing detector.

The "CIS" stands for a contact image sensor that contributes to a reduction in size of a device in recent years. The CIS uses small-size LEDs (light emitting diodes) as light sources to directly read an image by linear sensors via lenses. Each of the first CIS 101, the second CIS 102 and the third CIS 103 includes multiple line sensors aligned in the width direction of the sheet P so as to detect a side edge Pa of one end side in the width direction of the sheet P. Specifically, the first CIS 101 and the second CIS 102 are disposed at the upstream side from the pair of sheet holding rollers 31 and at the downstream side from the pair of sheet conveying rollers 44 that is disposed at one upstream position from the pair of sheet holding rollers 31. By contrast, the third CIS 103 is disposed at the downstream side from the pair of sheet holding rollers 31 and at the upstream side from the transfer cylinder 8. The first CIS 101, the second CIS 102 and the third CIS 103 are disposed parallel to each other relative to the width direction of the sheet P (i.e., a direction perpendicular to the sheet conveying direction).

Each of the downstream side leading end detection sensor 200 and the upstream side leading end detection sensor 220 includes a reflective optical sensor. The upstream side leading end detection sensor 220 is disposed upstream from the pair of sheet holding rollers 31 and downstream from the second CIS 102 in the sheet conveying direction. The downstream side leading end detection sensor 200 is disposed downstream from the pair of sheet holding rollers 31 and upstream from the third. CIS 103 in the sheet conveying direction. As the sheet P is conveyed, the leading end portion Pb of the sheet P is detected by the upstream side leading end detection sensor 220. Consequently, the sheet conveyance timing at which the leading end portion Pb of the sheet P reaches the upstream side leading end detection sensor 220 is detected. Further, as the leading end portion Pb of the sheet P reaches the position of the downstream side leading end detection sensor 200 after the sheet P is held by the pair of sheet holding rollers 31, the leading end portion Pb of the sheet P is detected by the downstream side leading end detection sensor 200. Then, the sheet conveyance timing at which the leading end portion Pb of the sheet P reaches the downstream side leading end detection sensor 200 is detected.

The pair of sheet holding rollers 31 moves in the width direction (i.e., in a direction indicated by arrow S in FIG. 2) of the sheet P while holding (gripping) the sheet P under conveyance and rotates about the support shaft 73 within a plane of sheet conveyance (i.e., in a direction indicate by arrow W in FIG. 2). By so doing, the pair of sheet holding rollers 31 changes the position of the sheet P. As a result, the lateral displacement $\alpha$ of the sheet P and the angular displacement $\beta$ of the sheet P are corrected. In other words, the pair of sheet holding rollers 31 functions as a positional deviation correcting unit to correct the angular and lateral displacements of the sheet P. In the present embodiment, the support shaft 73 is provided on the one end side in the axial direction of the pair of sheet holding rollers 31. However, the position of the support shaft 73 is not limited thereto. For example, the support shaft 73 may be provided at the axial center position of the pair of sheet holding rollers 31.

Figure 3:
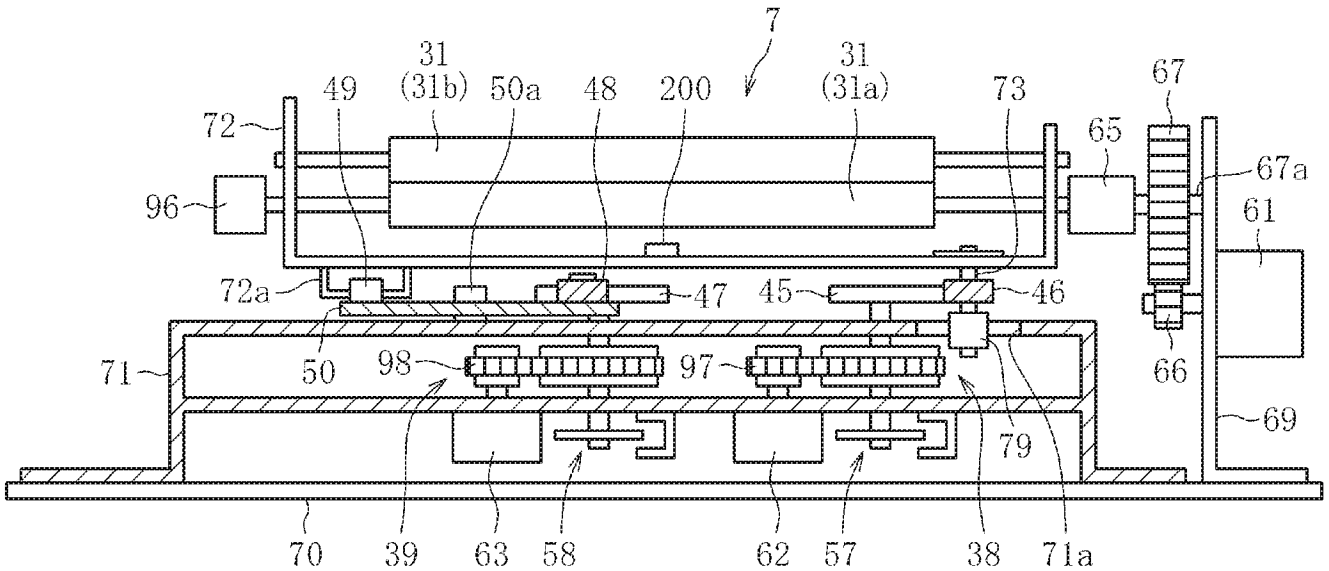
FIG. 3 is a side view illustrating a driving mechanism to drive a pair of sheet holding rollers.
Figure 4:
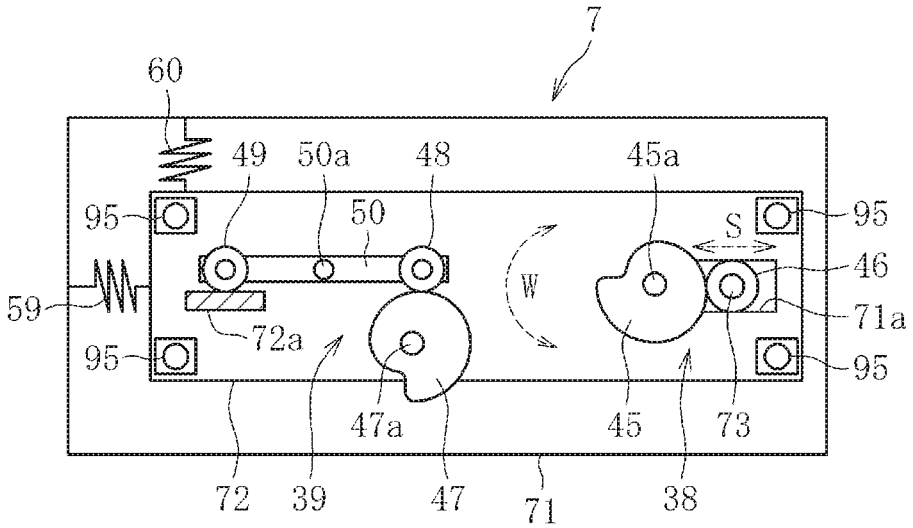
FIG. 4 is a plan view illustrating the driving mechanism to drive the pair of sheet holding rollers.

FIGS. 3 and 4 are diagrams illustrating the pair of sheet holding rollers 31 and a driving mechanism to drive the pair of sheet holding rollers 31. FIG. 3 is a side view illustrating the driving mechanism and FIG. 4 is a plan view illustrating the driving mechanism.

As illustrated in FIG. 3, the pair of sheet holding rollers 31 includes a drive roller 31*a* and a driven roller 31*b*. The drive roller 31*a* drivingly rotates about a roller shaft thereof. The driven roller 31*b* is rotated along with rotation of the drive roller 31*a*. The pair of sheet holding rollers 31 is rotatably held by a holder frame 72 that functions as a holding body to rotate about the roller shaft. The holder frame 72 is supported by a base frame 71 fixed to a body frame 70 of the inkjet type image forming apparatus 100.

As illustrated in FIG. 4, the holder frame 72 is mounted on the base frame 71 via free bearings (ball transfers) 95 that function as a relay support. As a result, the holder frame 72 is movable in any direction within a plane of sheet conveyance (within a plane of conveyance of a conveyance target medium) along the upper surface of the base frame 71. As described above, by supporting the holder frame 72 using the free bearings 95, the friction load generated when the holder frame 72 moves can be made extremely small. Accordingly, the correction of the angular and lateral displacements of the sheet P, which is described below, is performed at high speed and with high accuracy. In the present embodiment, the holder frame 72 is supported by the four free bearings 95. However, the number of the free bearings 95 is not limited thereto. For example, the number of the free bearings 95 may be three or more.

Further, as illustrated in FIG. 3, the holder frame 72 includes the support shaft 73 that is as a rotation center of the pair of sheet holding rollers 31 within a plane of sheet conveyance that is provided to extend downwardly. The lower end portion of the support shaft 73 is inserted into a lateral guide portion 71*a* formed in the base frame 71. The lateral guide portion 71*a* is an opening or a hole portion formed so as to extend substantially linearly in the width direction (i.e., the direction indicated by arrow S in FIG. 4). Further, a guide roller 79 is rotatably provided at the lower end portion of the support shaft 73. The support shaft 73 is inserted so as to contact the lateral guide portion 71*a* via the guide roller 79. As the support shaft 73 moves in the width direction along the lateral guide portion 71*a*, the holder frame 72 and the pair of sheet holding rollers 31 that is held by the holder frame 72 also move in the width direction. Further, the holder frame 72 also rotates around the support shaft 73 within a plane of sheet conveyance (in the direction indicated by arrow W in FIG. 4). As the holder frame 72 rotates around the support shaft 73, the pair of sheet holding rollers 31 rotates within a plane of sheet conveyance.

As illustrated in FIG. 3, a bracket 69 is provided on the right end side of the body frame 70 and a conveyance drive motor (conveyance drive unit) 61 is provided on the bracket 69 to apply a driving force to convey a sheet to the pair of sheet holding rollers 31. The conveyance drive motor 61 and the drive roller 31*a* of the pair of sheet holding rollers 31 are coupled via a gear train including multiple gears 66 and 67 and a coupling mechanism 65. The coupling mechanism 65 is a two-step spline coupling. Even if the rotary shaft of the drive roller 31*a* and the rotary shaft of the gear 67 are separated or approached in the axial direction from each other or driven in a direction in which these rotary shafts are inclined with respect to each other, the coupling mechanism 65 holds the connection so that the driving force can be transmitted. Since the drive roller 31*a* and the gear 67 are coupled via the coupling mechanism 65 as described above, the pair of sheet holding rollers 31 moves in the width direction or rotates within a plane of sheet conveyance. Accordingly, even when a relative position of the drive roller 31*a* and the conveyance drive motor 61 is changed, the drive force transmission from the conveyance drive motor 61 to the drive roller 31*a* is preferably performed.

Further, as illustrated in FIG. 3, a rotary encoder 96 is mounted at the end portion of the drive roller 31*a* (i.e., at an end portion on the opposite side from the conveyance drive motor 61). The rotary encoder 96 functions as a rotation speed detector to detect the conveyance rotation speed of the drive roller 31*a* (or the conveyance drive motor 61). The conveyance rotation speed of the pair of sheet holding rollers 31 is controlled based on the detection result of the rotary encoder 96.

Further, the sheet conveying device 7 according to the present embodiment includes a lateral driving mechanism 38 and an angular driving mechanism 39. The lateral driving mechanism 38 causes the holder frame 72 and the pair of sheet holding rollers 31 to move in the width direction. The angular driving mechanism 39 causes the holder frame 72 and the pair of sheet holding rollers 31 to rotate within a plane of sheet conveyance.

As illustrated in FIGS. 3 and 4, the lateral driving mechanism 38 includes a lateral drive motor (a lateral drive body) 62, a timing belt 97, a cam 45 and a tension spring 59. The tension spring 59 is connected to the holder frame 72 and the base frame 71 so as to bias the holder frame 72 in one direction (i.e., the left direction in FIG. 4) in the width direction. The cam 45 is held by the base frame 71 to be rotatable about a rotary shaft 45*a*. Further, the cam 45 is held in contact with a cam follower 46 provided on the support shaft 73 by the biasing force of the tension spring 59. As the cam 45 rotates, the cam follower 46 is pushed against the biasing force applied by the tension spring 59. Accordingly, the holder frame 72 moves in the width direction (i.e., the right direction in FIG. 4).

Further, as illustrated in FIG. 3, the timing belt 97 is wound around the rotary shaft 45*a* of the cam 45 and the motor shaft of the lateral drive motor 62. As a result, the driving force is transmitted from the lateral drive motor 62 to the cam 45 via the timing belt 97. Further, a rotary encoder 57 is mounted on the rotary shaft 45*a* of the cam 45. The rotary encoder 57 functions as a rotation angle detector to detect the rotation angle (rotation amount) of the cam 45. By controlling the driving of the lateral drive motor 62 based on the detection result of the rotary encoder 57, the rotation angle of the cam 45 is controlled, and the amount of movement of the holder frame 72 in the width direction is adjusted. That is, the rotary encoder 57 functions as a drive position detector that detects a drive position when the holder frame 72 and the pair of sheet holding rollers 31 move in the width direction.

As illustrated in FIGS. 3 and 4, the angular driving mechanism 39 includes an angular drive motor (an angular drive body) 63, a timing belt 98, a cam 47, a tension spring 60 and a lever 50. The tension spring 60 is connected to the holder frame 72 and the base frame 71 so as to bias the holder frame 72 in one direction (i.e., a clockwise direction around the support shaft 73 in FIG. 4) of the rotation (angular) direction. The cam 47 is provided on the base frame 71 so as to be rotatable around a rotary shaft 47*a* thereof. In addition, the cam 47 is held in contact with a cam follower 48 provided at one end of the lever 50 by the biasing force of the tension spring 60. An action roller 49 is rotatably provided at an end portion on the opposite side of the lever 50. The action roller 49 is held in contact with a projection 72*a* provided to the holder frame 72 by the biasing force of the tension spring 60. With the above-described configuration, when the cam 47 rotates and the cam follower 48 is pushed by the cam 47, the lever 50 rotates about a rotary shaft 50*a* thereof. Along with this operation, the action roller 49 provided on the lever 50 pushes the projection 72*a* of the holder frame 72 against the biasing force of the tension spring 60, so that the holder frame 72 rotates within a plane of sheet conveyance (in a counter-clockwise direction in FIG. 4).

Further, as illustrated in FIG. 3, a timing belt 98 is wound around the rotary shaft 47*a* of the cam 47 and the motor shaft of the angular drive motor 63. According to this configuration, the driving force is transmitted from the angular drive motor 63 to the cam 47 via the timing belt 98. Further, a rotary encoder 58 is mounted on the rotary shaft 47*a* of the cam 47. The rotary encoder 58 functions as a rotation angle detector to detect the rotation angle (rotation amount) of the cam 47. By controlling the driving of the angular drive motor 63 based on the detection result of the rotary encoder 58, the rotation angle of the cam 47 is controlled, and the number of rotations of the holder frame 72 in the within a plane of sheet conveyance is adjusted. That is, the rotary encoder 58 functions as a drive position detector that detects a drive position when the holder frame 72 and the pair of sheet holding rollers 31 rotate within a plane of sheet conveyance.

Figure 5A:
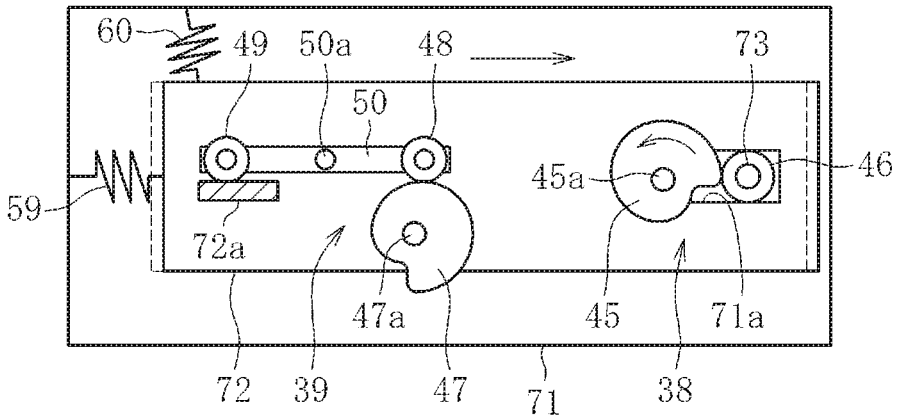
FIG. 5A is a diagram illustrating a state in which a support frame has moved in the width direction.
Figure 5B:
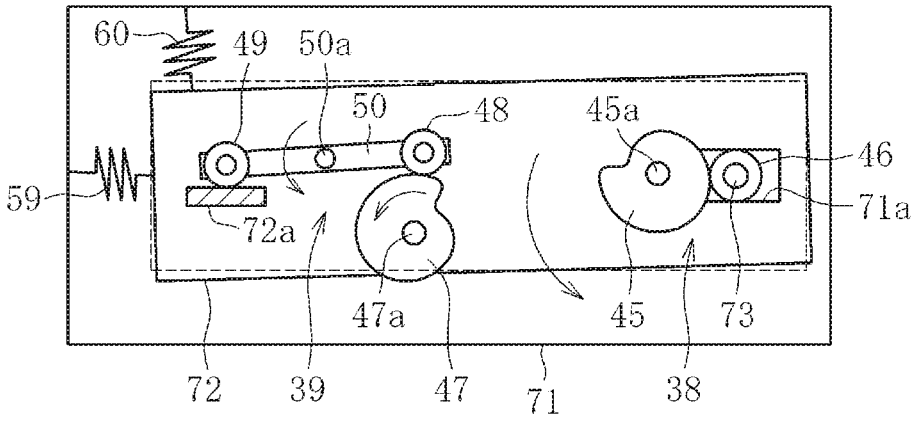
FIG. 5B is a diagram illustrating a state in which the support frame has removed in the rotation direction within a plane of sheet conveyance.
Figure 5C:
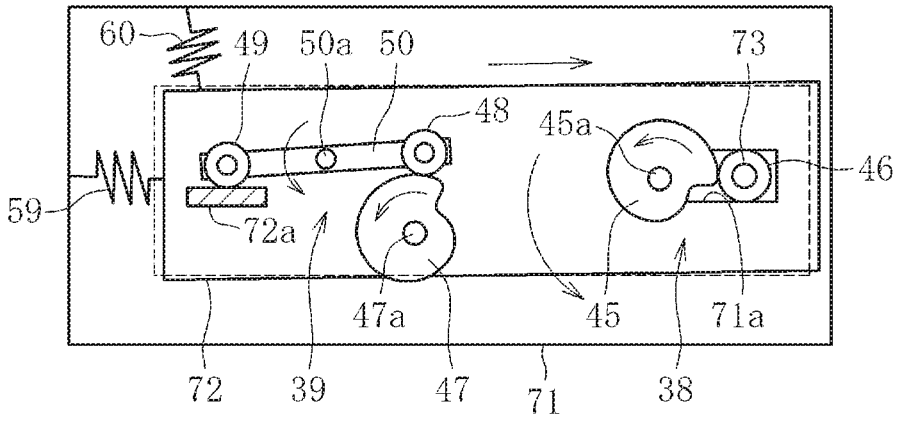
FIG. 5C is a diagram illustrating a state in which the support frame has moved in the width direction and the rotation direction within a plane of sheet conveyance.

FIG. 5A is a diagram illustrating a state in which the cam 45 of the lateral driving mechanism 38 has rotated and the holder frame 72 has moved in the width direction. FIG. 5B is a diagram illustrating a state in which the cam 47 of the angular driving mechanism 39 has rotated and the holder frame 72 has rotated within a plane of sheet conveyance. FIG. 5C is a diagram illustrating a state in which both the cam 45 and the cam 47 has rotated and the holder frame 72 has moved in the width direction and rotated within a plane of sheet conveyance.

Further, as illustrated in FIG. 3, the downstream side leading end detection sensor 200 is provided on the holder frame 72. Accordingly, when the holder frame 72 moves in the width direction or rotates within a plane of sheet conveyance as described above, the downstream side leading end detection sensor 200 moves together (integrally) with the holder frame 72 in the width direction or within a plane of sheet conveyance. By contrast, the upstream side leading end detection sensor 220 is fixed so as not to move onto the sheet conveyance passage.

Figure 6:
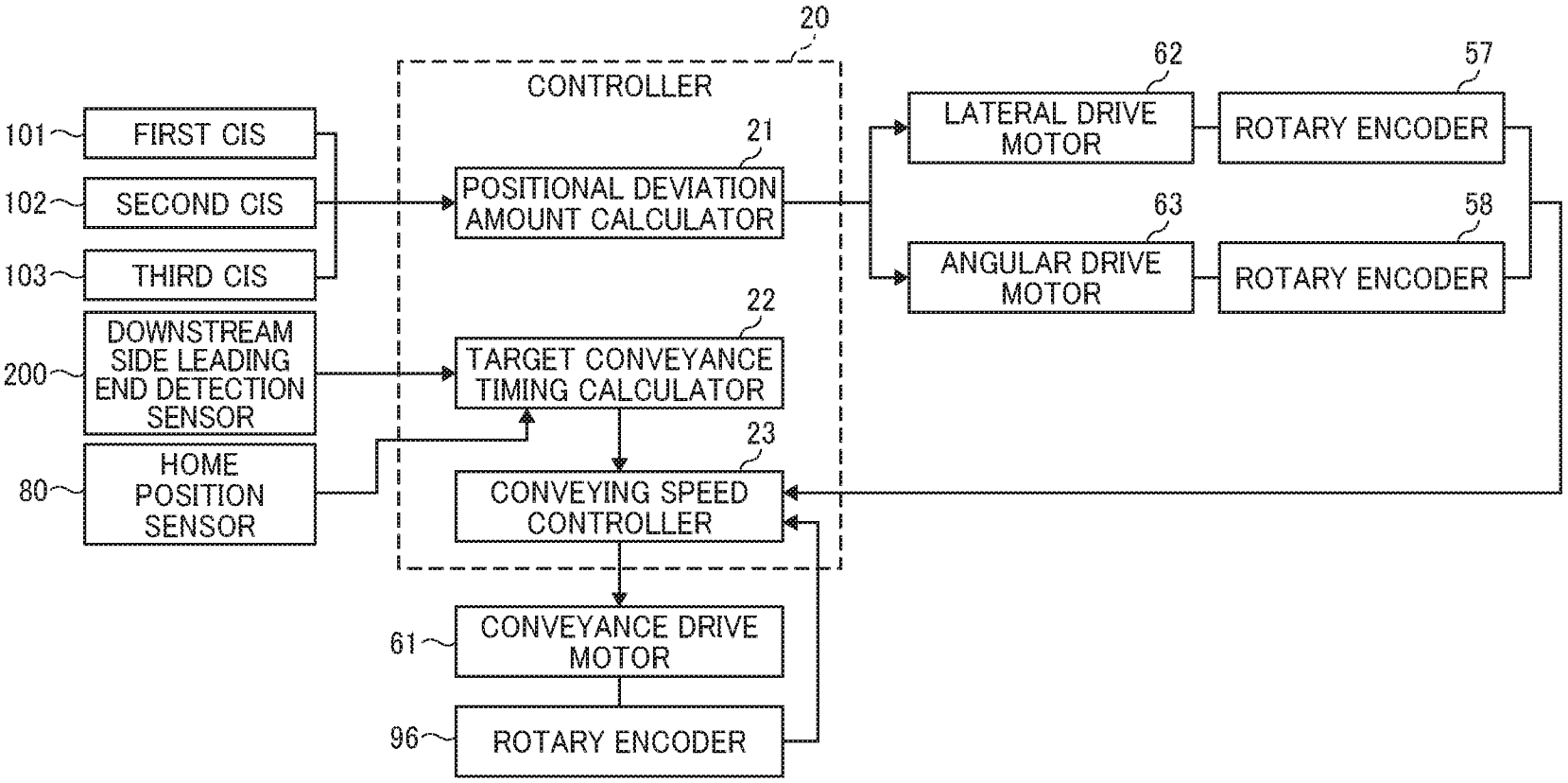
FIG. 6 is a block diagram illustrating a control system of the sheet conveying device according to the present embodiment of this disclosure.

FIG. 6 is a block diagram illustrating a control system of the sheet conveying device 7 according to the present embodiment of this disclosure.

As illustrated in FIG. 6, the sheet conveying device 7 according to the present embodiment includes a controller 20 that individually controls the conveyance drive motor 61 that applies a driving force to convey a sheet to the pair of sheet holding rollers 31, the lateral drive motor 62 that causes the pair of sheet holding rollers 31 to move in the width direction, and the angular drive motor 63 that causes the pair of sheet holding rollers 31 to rotate within a plane of sheet conveyance. That is, the controller 20 controls the conveyance rotation speed, the movement amount in the width direction and the rotation amount within a plane of sheet conveyance of the pair of sheet holding rollers 31.

The controller 20 includes a positional deviation amount calculator 21, a target conveyance timing calculator 22 and a conveying speed controller 23. The positional deviation amount calculator 21 calculates an amount of positional deviation of a sheet based on the detection results of the first CIS 101, the second CIS 102 and the third CIS 103. The target conveyance timing calculator 22 calculates a target conveyance timing of a sheet to a predetermined target position based on the detection result of the downstream side leading end detection sensor 200 and the detection result of a home position sensor 80 (see FIG. 1) provided on the transfer cylinder 8. The conveying speed controller 23 controls a conveying speed (i.e., the conveyance rotation speed of the pair of sheet holding rollers 31) of a sheet based on the target conveyance timing calculated by the target conveyance timing calculator 22. The conveying speed controller 23 also adjusts the conveying speed based on information of the rotary encoder 96 to detect the conveyance rotation speed of the pair of sheet holding rollers 31 and information of the rotary encoders 57 and 58 to detect the movement amount in the width direction and the rotation amount within a plane of sheet conveyance of the pair of sheet holding rollers 31.

For example, the controller 20 may be implemented using hardware, a combination of hardware and software, or a non-transitory storage medium storing software that is executable to perform the functions of the same. For example, in some example embodiments, the controller 20 may include a memory and a processing circuitry. The memory may include a nonvolatile memory device, a volatile memory device, a non-transitory storage medium, or a combination of two or more of the above-mentioned devices.

The processing circuitry may be, but not limited to, a processor, Central Processing Unit (CPU), a controller, an arithmetic logic unit (ALU), a digital signal processor, a microcomputer, a field programmable gate array (FPGA), an Application Specific Integrated Circuit (ASIC), a System-on-Chip (SoC), a programmable logic unit, a microprocessor, or any other device capable of performing operations in a defined manner. The processing circuitry may be configured, through a layout design and/or execution of computer readable instructions stored in a memory, as a special purpose computer to perform the functions of the positional deviation amount calculator 21, the target conveyance timing calculator 22 and/or the conveying speed controller 23.

In other example embodiments, the controller 20 may include integrated circuit (IC) specially customized into special purpose processing circuitry (e.g., an ASIC) to perform the functions of the positional deviation amount calculator 21, the target conveyance timing calculator 22 and/or the conveying speed controller 23.

In the present embodiment, the sheet P is to reach a sheet gripping position A (see FIG. 1) on the transfer cylinder 8 that rotates at a constant velocity, at the same timing as an arrival timing of the gripper 16 mounted on the transfer cylinder 8, arriving at the sheet gripping position A. The timing at which the gripper 16 reaches the sheet gripping position A may be specified by detecting a rotation reference position C of the transfer cylinder 8 by the home position sensor 80. It is to be noted that, even though the transfer cylinder 8 in the present embodiment includes one gripper (i.e., the gripper 16), two or more grippers may be provided to the transfer cylinder 8. Further, in the present embodiment, the sheet P is adjusted to the same speed each time at a target position B (see FIG. 1) slightly before (near the upstream side) from the sheet gripping position A. Thereafter, the sheet P is conveyed to reach the sheet gripping position A at a constant velocity. Therefore, in the present embodiment, the timing at which the sheet P reaches this target position B is set as the target conveyance timing. As described above, in the present embodiment, a speed adjustment complete position at which the conveying speed of the sheet P is completely adjusted is set as the target position B. However, in a case in which the sheet P is not conveyed at a constant velocity, to a final target conveyance position such as the sheet gripping position A, the final target conveyance position may be the target position B. The calculated target conveyance timing may be, for example, the time from when the leading end portion Pb of the sheet P is detected by the downstream side leading end detection sensor 200 to when the sheet P reaches the target position B at a predetermined timing or may be the conveyance rotation speed of the pair of sheet holding rollers 31 that enables the sheet P to reach the target position B within this time.

Figure 7:
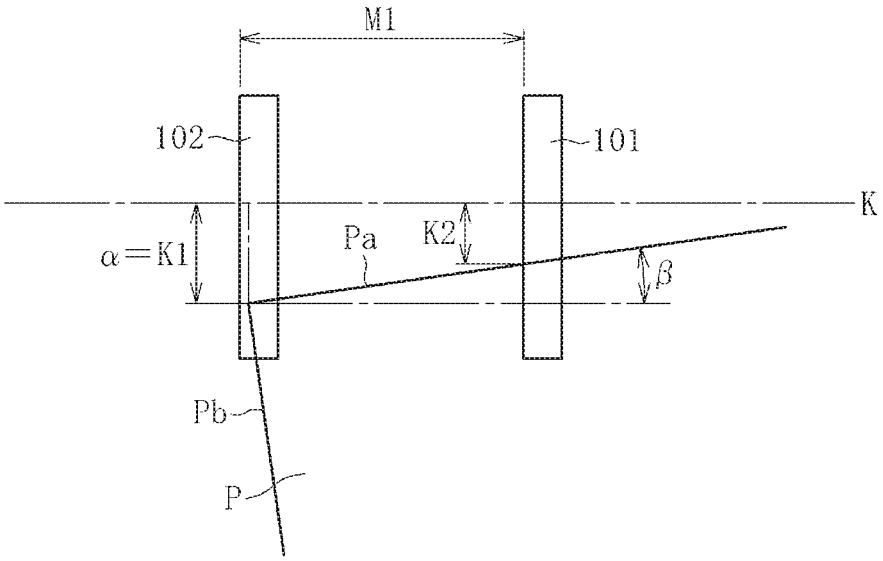
FIG. 7 is a diagram illustrating a position of the sheet for calculating a positional deviation amount of the sheet based on position information of the sheet obtained by using two CISs.
Figure 8:
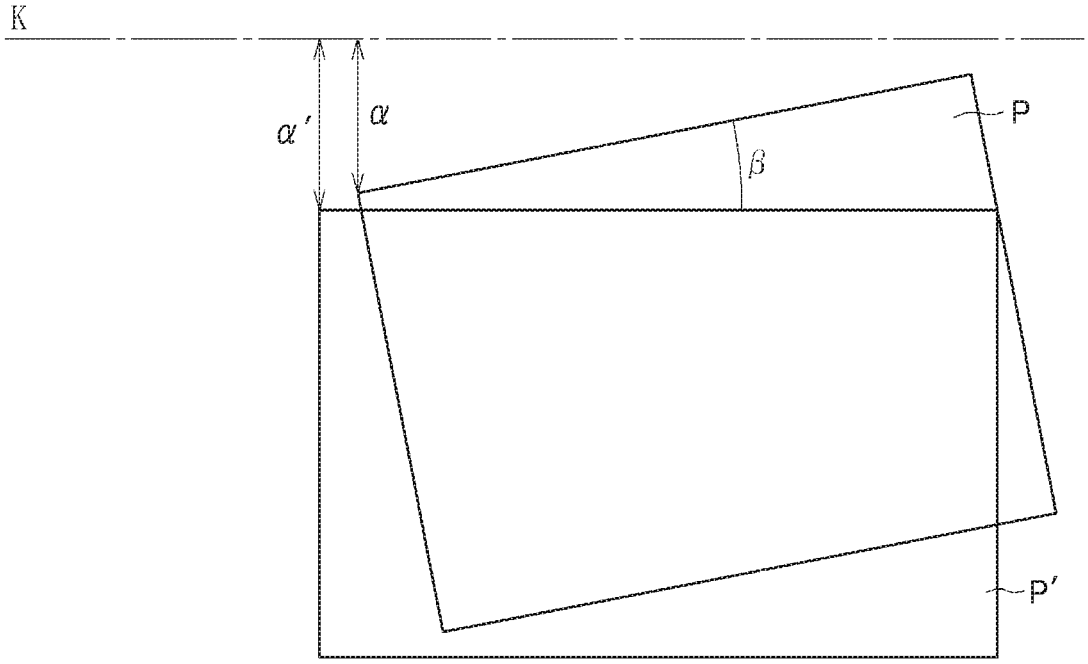
FIG. 8 is a diagram for explaining a lateral displacement amount of a sheet.

Here, a description is given of a method of calculating angular and lateral displacement amounts of a sheet, with reference to FIGS. 7 and 8. It is to be noted that a method of calculating a positional deviation amount, that is, angular and lateral displacement amounts of a sheet using the first CIS 101 (in this case, as an upstream position detector) and the second CIS 102 (in this case, as a downstream position detector) is illustrated in FIG. 7. However, the method is not limited thereto. For example, a method of calculating angular and lateral displacement amounts of a sheet using the second CIS 102 (in this case, as an upstream position detector) and the third CIS 103 (in this case, as a downstream position detector) may also be applied to this disclosure.

As illustrated in FIG. 7, when the leading end Pb of the sheet P passes the first CIS 101 and reaches the second CIS 102, the lateral displacement amount α of the sheet P and the angular displacement amount β of the sheet P are detected.

Specifically, the lateral displacement amount α of the sheet P is calculated based on a position in the width direction of the sheet P detected by the second CIS 102 (i.e., a position of the side edge Pa of the sheet P). That is, the position in the width direction detected by the second CIS 102 is compared with the conveyance reference position K. Consequently, a distance K1 extending between the position of the sheet P and the conveyance reference position K is calculated as a lateral displacement amount α of the sheet P.

Further, the angular displacement amount β of the sheet P is calculated based on a difference of end positions in the width direction of the sheet P detected by the first CIS 101 and the second CIS 102. That is, as illustrated in FIG. 7, at the moment when the leading end Pb of the sheet P reaches the second CIS 102, the distance K1 and a distance K2 in the width direction from the conveyance reference position K are detected by the first CIS 101 and the second CIS 102, respectively. Consequently, since a distance M1 in the sheet conveying direction between the first CIS 101 and the second CIS 102 is previously determined, the angular displacement amount β to the sheet conveying direction of the sheet P is obtained based on an equation of $\tan \beta=(K1-K2)/M1$.

As described above, the lateral displacement amount α of the sheet P and the angular displacement amount β of the sheet P are calculated. It is to be noted that, as illustrated in FIG. 8, after the angular displacement β has been corrected, as the position of the sheet P changes to a sheet P', the lateral displacement amount α of the sheet P changes to a lateral displacement amount α' of the sheet P'. Therefore, by previously calculating the lateral displacement amount α' of the sheet P', the lateral displacement α of the sheet P is corrected with higher accuracy. However, the lateral displacement amount α' of the sheet P' varies depending on a reference position of the correction of the angular displacement β.

In order to address this inconvenience and correct positional deviations such as an angular displacement of a sheet without degrading the productivity, a comparative sheet conveying device corrects a positional deviation without stopping conveyance of the sheet by driving a pair of rollers in a direction opposite to the direction of the positional deviation of the sheet while conveying the sheet.

Figure 26:
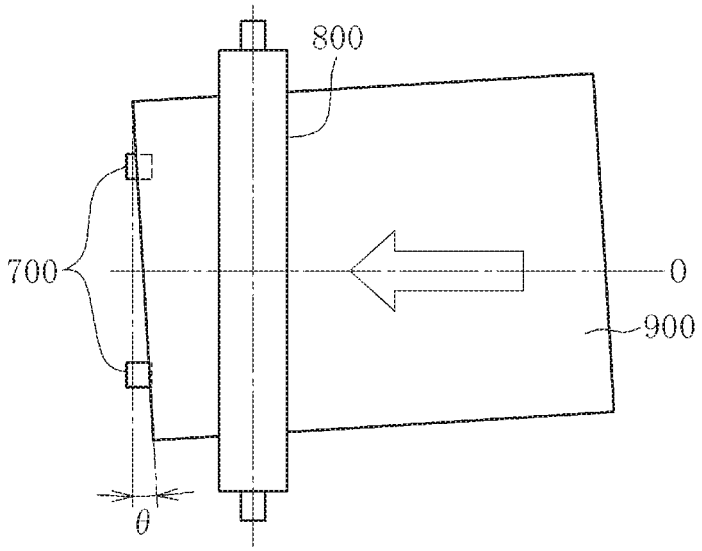
FIG. 26 is a plan view of a comparative sheet conveying device.
Figure 27:
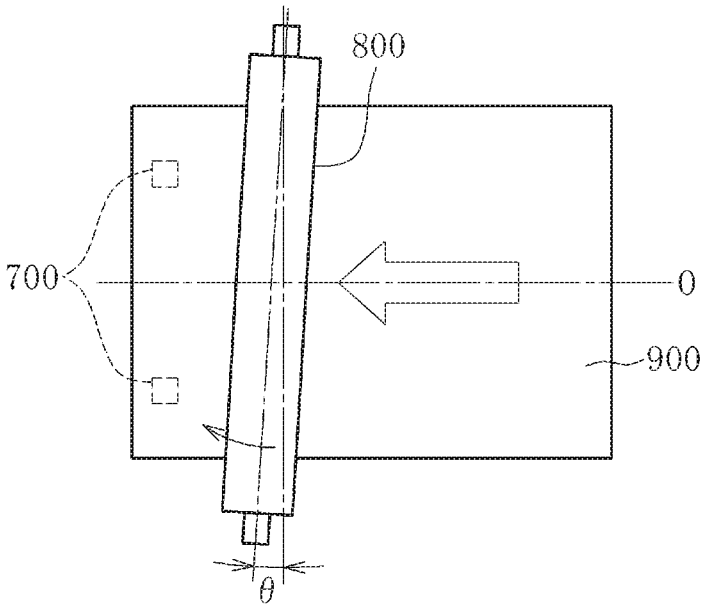
FIG. 27 is a plan view of the comparative sheet conveying device.

Specifically, as illustrated in FIG. 26, the comparative sheet conveying device detects the leading end of a sheet 900 by a pair of angular displacement detection sensor 700 aligned in a direction perpendicular to a sheet conveying direction indicated by arrow O, and an angular displacement amount θ of the sheet 900 based on the detection result. Then, as illustrated in FIG. 27, by rotating a pair of sheet conveying rollers (a pair of registration rollers) 800 according to the calculated angular displacement amount θ, the positional deviation (i.e., the angular displacement amount) of the sheet 900 is corrected.

When the positional deviation of a sheet is corrected while the sheet is being conveyed, the position of the leading end of the sheet changes, and therefore an amount of time that the leading end of the sheet reaches a predetermined target position varies. Consequently, if the sheet is conveyed at a predetermined conveying speed, the timing at which the sheet reaches the target position is shifted, which causes an inconvenience that the sheet cannot be conveyed with high accuracy.

In order to solve the shift of the timing at which the sheet reaches the target position caused by the correction of the positional deviation of the sheet, the comparative sheet conveying device calculates the position of the leading end of the sheet after the correction of the positional deviation of the sheet based on the positional deviation amount of the sheet, and the sheet conveying speed is adjusted based on the calculation result.

However, the comparative sheet conveying device cannot detect the angular displacement of the sheet after the leading end of the sheet has passed the angular displacement detection sensor. That is, the detection of the angular displacement of each sheet is performed for one time in total. Therefore, the correction of the angular and lateral displacements of the sheet is also performed for one time. Consequently, when the sheet further shifts after the correction of the positional deviation of the sheet the comparative sheet conveying device cannot convey the sheet with high accuracy.

Figure 13A:
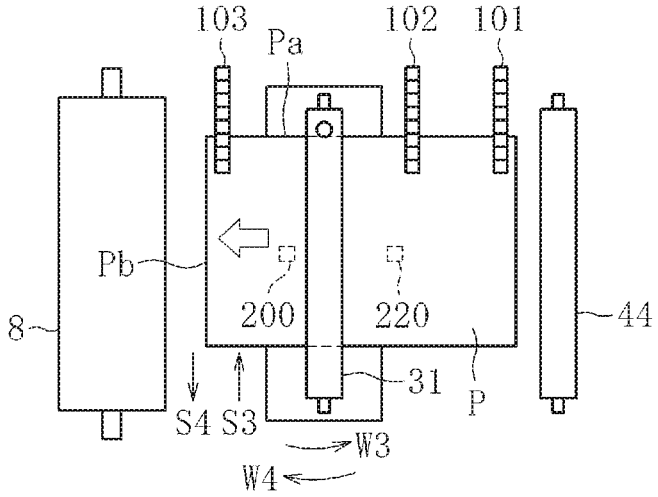
FIG. 13A is a plan view illustrating movement of the sheet conveying device according to the present embodiment of this disclosure.
Figure 13B:
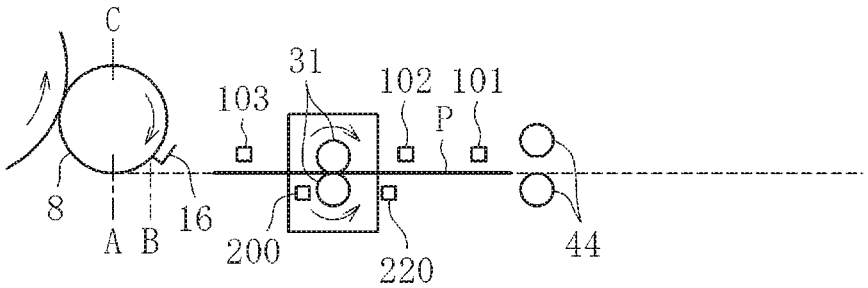
FIG. 13B is a side view illustrating the movement of the sheet conveying device of FIG. 13A.
Figure 14A:
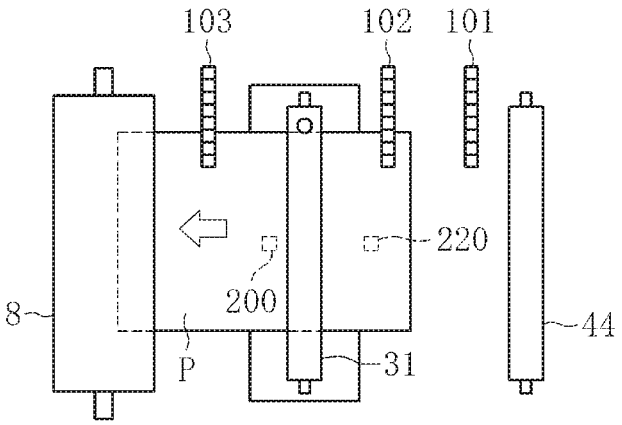
FIG. 14A is a plan view illustrating movement of the sheet conveying device according to the present embodiment of this disclosure.
Figure 14B:
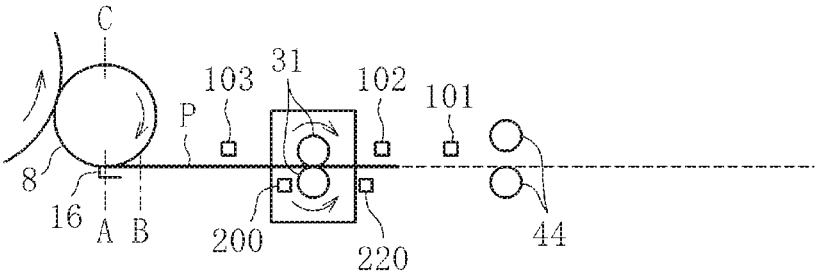
FIG. 14B is a side view illustrating the movement of the sheet conveying device of FIG. 14A.
Figure 15:
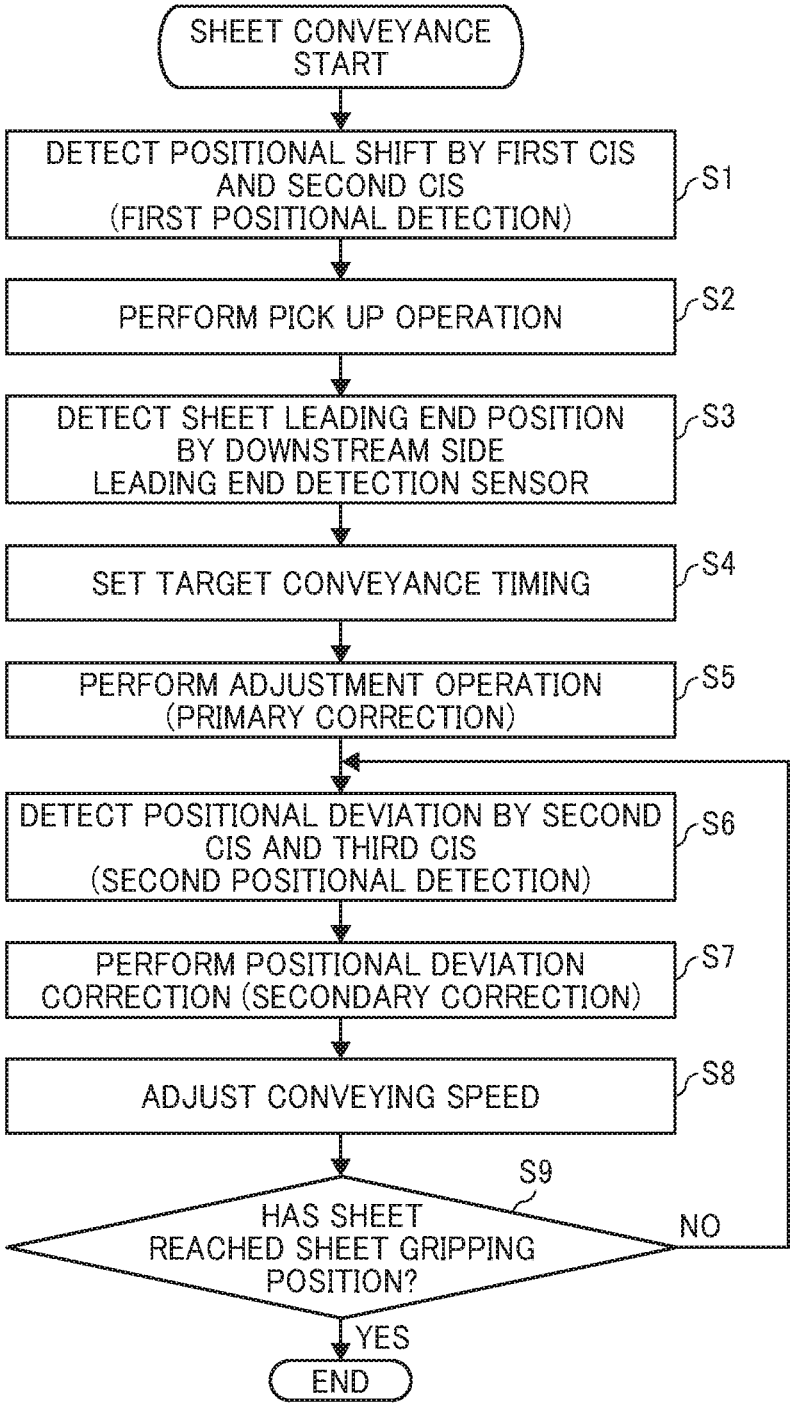
FIG. 15 is a flowchart illustrating the sheet conveying device according to the present embodiment of this disclosure.

Next, a description is given of the operations of the sheet conveying device 7 according to the present embodiment, with reference to the plan views and side views of FIGS. 9A through 14B and the flowchart of FIG. 15.

Figure 9A:
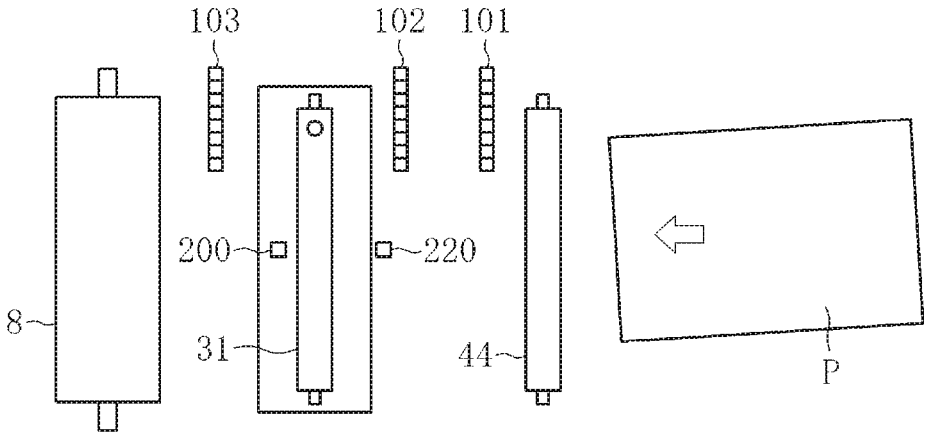
FIG. 9A is a plan view illustrating movement of the sheet conveying device according to the present embodiment of this disclosure.
Figure 9B:
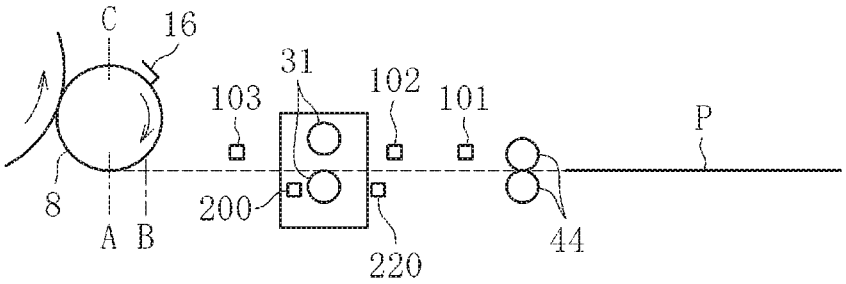
FIG. 9B is a side view illustrating the movement of the sheet conveying device of FIG. 9A.

As illustrated in FIGS. 9A and 9B, when the sheet P is conveyed, the pair of sheet holding rollers 31 is disposed at a home position at which the roller shaft of the pair of sheet holding rollers 31 extends in a direction perpendicular to the sheet conveying direction (i.e., in the left and right directions in FIGS. 9A and 9B). Further, in this state, the two rollers (i.e., the drive roller 31*a* and the driven roller 31*b*) of the pair of sheet holding rollers 31 are separated from each other and remains in a stationary state.

Figure 10A:
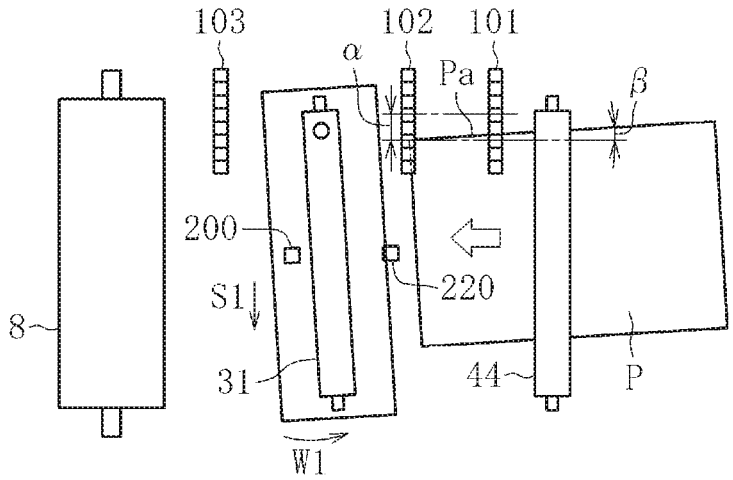
FIG. 10A is a plan view illustrating movement of the sheet conveying device according to the present embodiment of this disclosure.
Figure 10B:
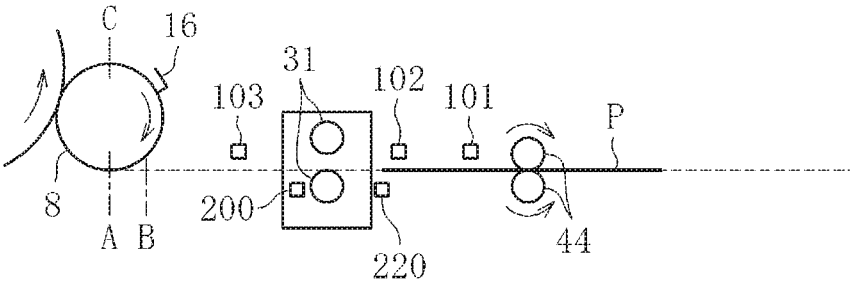
FIG. 10B is a side view illustrating the movement of the sheet conveying device of FIG. 10A.

Thereafter, as illustrated in FIGS. 10A and 10B, when the leading end portion Pb of the sheet P passes by the first CIS 101 (in this case, as an upstream position detector) and reaches the second CIS 102 (in this case, as a downstream position detector), the first CIS 101 and the second CIS 102 perform a "first positional detection" to detect the position of the side end portion Pa of the sheet P (step S1 in the flowchart of FIG. 15). Then, the positional deviation amount calculator 21 (see FIG. 6) calculates the lateral displacement amount α (or the lateral displacement amount α' together with the angular displacement amount β) based on the position information detected by the first CIS 101 and the second CIS 102. Then, based on the calculated positional deviation amount, the lateral drive motor 62 and the angular drive motor 63 are controlled to move the pair of sheet holding rollers 31 in the width direction (i.e., in the direction indicated by arrow S1 in FIG. 10A) and rotate within a plane of sheet conveyance (i.e., in the direction indicated by arrow W1 in FIG. 10A. As a result, the pair of sheet holding rollers 31 performs a pick up operation in which the pair of sheet holding rollers 31 moves to face leading end Pb of the sheet P (step S2 in the flowchart of FIG. 15).

Figure 11A:
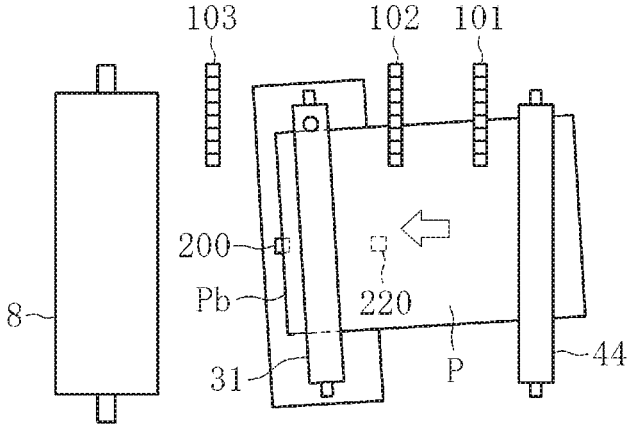
FIG. 11A is a plan view illustrating movement of the sheet conveying device according to the present embodiment of this disclosure.
Figure 11B:
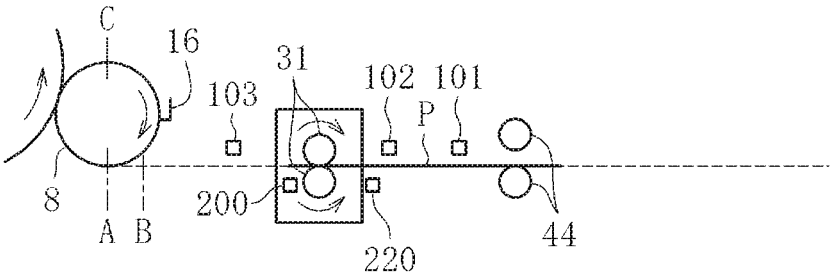
FIG. 11B is a side view illustrating the movement of the sheet conveying device of FIG. 11A.

Then, the leading end portion Pb of the sheet P is detected by the upstream side leading end detection sensor 220, and based on the detection timing, the rollers of the pair of sheet holding rollers 31 come into contact with each other and start the conveying rotations. Thereafter, as illustrated in FIGS. 11A and 11B, the sheet P is picked up by the pair of sheet holding rollers 31 that is facing the sheet P, and the sheet P is conveyed while being held by the pair of sheet holding rollers 31. It is to be noted that, at the moment the pair of sheet holding rollers 31 receives the sheet P, the rollers of the pair of sheet conveying rollers 44 disposed upstream from the pair of sheet holding rollers 31 in the sheet conveying direction are separated.

Further, as illustrated in FIGS. 11A and 11B, as the sheet P is conveyed by the pair of sheet holding rollers 31 and the leading end Pb of the sheet P reaches the position of the downstream side leading end detection sensor 200, the downstream side leading end detection sensor 200 detects the leading end Pb of the sheet P (step S3 in the flowchart of FIG. 15). According to this operation, the timing at which the leading end Pb of the sheet P reaches the downstream side leading end detection sensor 200 is detected. Then, based on the detection result of the downstream side leading end detection sensor 200 and the detection result of the home position sensor 80 of the transfer cylinder 8, the target conveyance timing of the sheet P to the predetermined target position B is calculated by the target conveyance timing calculator 22 (see FIG. 6) to be set (step S4 in the flowchart of FIG. 15).

Figure 12A:
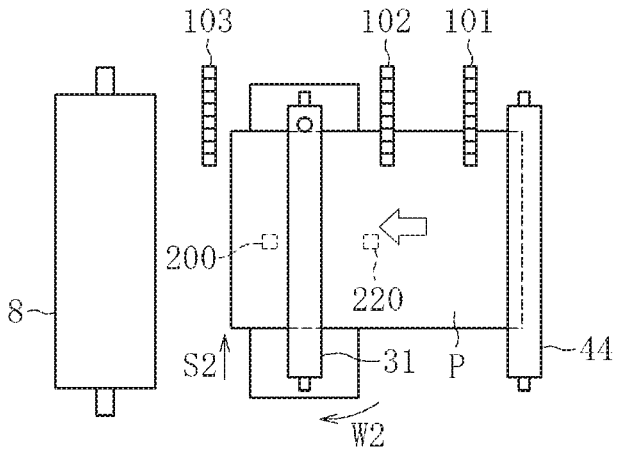
FIG. 12A is a plan view illustrating movement of the sheet conveying device according to the present embodiment of this disclosure.
Figure 12B:
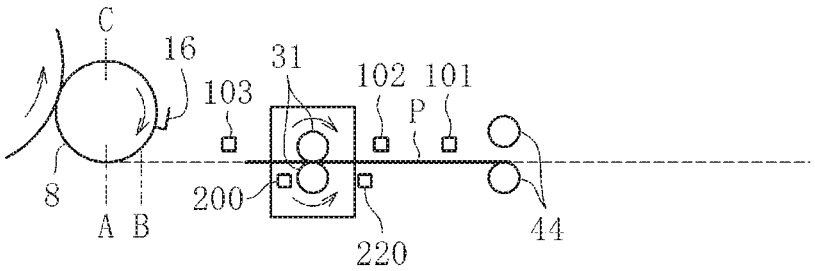
FIG. 12B is a side view illustrating the movement of the sheet conveying device of FIG. 12A.

Thereafter, as illustrated in FIGS. 12A and 12B, while holding (gripping) and conveying the sheet P, the pair of sheet holding rollers 31 performs an adjustment operation to move in directions (i.e., the direction indicated by arrow S2 and the direction indicated by arrow W2 in FIG. 12A) that are opposite to the directions of the pick up operation (step S5 in the flowchart of FIG. 15). As a result, a "primary correction" in which the lateral displacement of the sheet P and the angular displacement of the sheet P are corrected is performed.

Further, as illustrated in FIGS. 13A and 13B, when the leading end portion Pb of the sheet reaches the third CIS 103, a "second positional detection" in which the second CIS 102 and the third CIS 103 detect the position of the side edge Pa of the sheet P for the second time is performed (step S6 in the flowchart of FIG. 15). Based on the position information detected by the second CIS 102 (in this case, as an upstream position detector) and the third CIS 103 (in this case, as a downstream position detector), the angular and lateral displacement amounts of the sheet P are calculated by the positional deviation amount calculator 21. Then, based on the calculated angular and lateral displacement amounts of the sheet P, the lateral drive motor 62 is controlled to move the pair of sheet holding rollers 31 in the width direction (i.e., in a direction indicated by arrow S3 or in a direction indicated by arrow S4 in FIG. 13A and the angular drive motor 63 is controlled to rotate the pair of sheet holding rollers 31 within a plane of sheet conveyance (i.e., in a direction indicated by arrow W3 or in a direction indicated by arrow W4 in FIG. 13A. By so doing, a "secondary correction" in which the angular and lateral displacements of the sheet P are corrected is performed (step S7 in the flowchart of FIG. 15).

As described above, by detecting the angular and lateral displacements of the sheet P (i.e., the second position detection) even after the adjustment operation (i.e., the primary correction) and correcting the angular and lateral displacements of the sheet P based on the detection results (i.e., the secondary correction), the angular and lateral displacements of the sheet P that are generated while the sheet P is being conveyed by the pair of sheet holding rollers 31 is eliminated. Further, detection of the angular and lateral displacements of the sheet P after completion of the adjustment operation (i.e., the second position detection) may be performed multiple times at predetermined intervals during a period that the sheet P is passing by the second CIS 102 and the third CIS 103. Therefore, by performing the detection of the angular and lateral displacements of a sheet (i.e., the second position detection) for multiple times (repeatedly) and performing the correction of the angular and lateral displacements (i.e., the secondary correction) each time the above-described detection is performed, the sheet is conveyed with higher accuracy.

However, when the above-described correction of the angular and lateral displacements of the sheet (i.e., the secondary correction) is performed, the position of the sheet in the sheet conveying direction changes. Therefore, in a case in which the sheet having the change of the position in the sheet conveying direction is conveyed at the same conveying speed, the timing of arrival of the sheet to the target position B also changes. Therefore, in a case in which the sheet having the change of the position in the sheet conveying direction is conveyed at the same conveying speed, the timing of arrival of the sheet to the target position B also changes. In order to avoid this inconvenience, in the present embodiment, when the angular and lateral displacements of the sheet P are corrected after completion of the adjustment operation (i.e., the secondary correction), each time the correction of the angular and lateral displacements of the sheet P is performed, the conveying speed of the sheet P is changed (adjusted) based on the amount of correction of the angular and lateral displacements of the sheet P (a position after the change of the sheet P) (step S8 in the flowchart of FIG. 15). Then, as the sheet P is further conveyed to the downstream side in the sheet conveying direction at the changed conveying speed, the sheet P is conveyed to the sheet gripping position A at the same timing the gripper 16 reaches the sheet gripping position A, as illustrated in FIGS. 14A and 14B (step S9 in the flowchart of FIG. 15). At the moment the sheet P reaches the sheet gripping position A, the rollers of the pair of sheet holding rollers 31 are separated from each other, and the conveyance of the sheet P by the pair of sheet holding rollers 31 is completed. It is to be noted that, in a case in which no angular and lateral displacements of the sheet P are generated after completion of the adjustment operation and therefore the correction of the angular and lateral displacements of the sheet P (i.e., the secondary correction) has not been performed, the timing of arrival of the sheet P to the target position B does not change basically. Accordingly, no change is performed to the conveying speed of the sheet P corresponding to the correction of angular and lateral displacements of the sheet P the secondary correction).

Hereinafter, a description is given of a method of controlling the conveying speed of a sheet with reference to a flowchart of FIG. 16.

Figure 16:
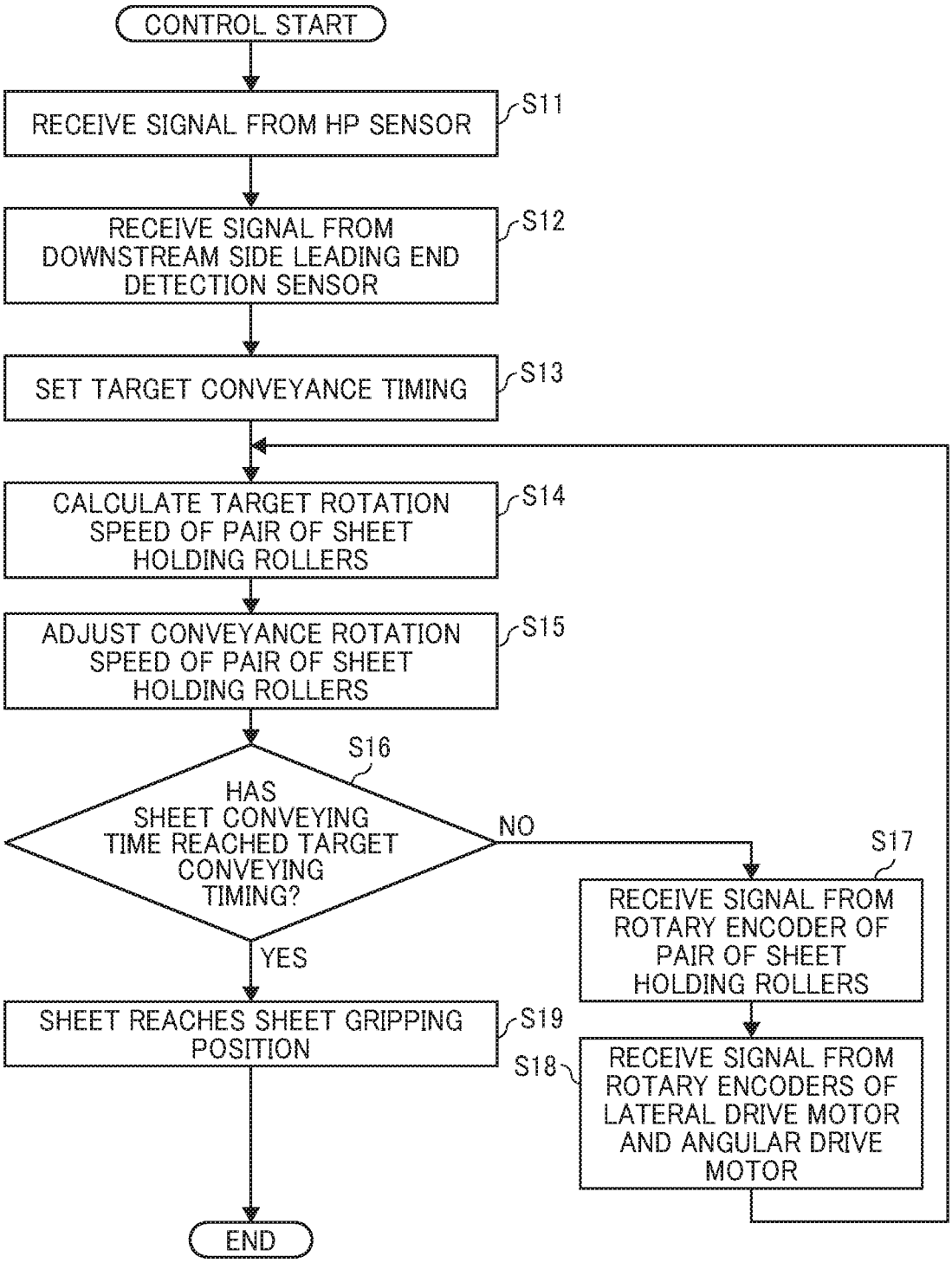
FIG. 16 is a flowchart illustrating a method of controlling a sheet conveying speed.

As illustrated in FIG. 16, when the control of the pair of sheet holding rollers 31 is started, it is confirmed that the gripper 16 is located at the rotation reference position C, based on the detection result of the home position sensor 80 of the transfer cylinder 8 before the target conveyance timing is set (step S11 of the flowchart in FIG. 16). Then, as described above, the downstream side leading end detection sensor 200 detects the leading end of the sheet (step S12 in the flowchart of FIG. 16). Then, the target conveyance timing is set based on the detection result of the downstream side leading end detection sensor 200 and the detection result of the home position sensor 80 of the transfer cylinder 8 (step S13 in the flowchart of FIG. 16).

The target rotation speed of the pair of sheet holding rollers 31 is calculated in accordance with the set target conveyance timing (step S14 in the flowchart of FIG. 16). It is to be noted that the calculation of the target rotation speed of the pair of sheet holding rollers 31 may be performed by the target conveyance timing calculator 22 or any other calculator. Then, based on the calculated target rotation speed of the pair of sheet holding rollers 31, the conveyance rotation speed of the pair of sheet holding rollers 31 is controlled (step S15 in the flowchart of FIG. 16).

Then, it is determined whether the sheet conveyance time has reached the target conveyance timing (step S16 in the flowchart of FIG. 16). When the sheet conveyance time has not yet reached the target conveyance timing (NO in step S16), the process proceeds to step S17.

In the present embodiment, the conveyance rotation speed of the pair of sheet holding rollers 31 is managed based on a signal from the rotary encoder 96 mounted on the pair of sheet holding rollers 31. Accordingly, in order to determine whether or not the conveyance rotation speed of the pair of sheet holding rollers 31 is faster or slower than the target rotation speed, the conveying speed controller 23 obtains the signal sent from the rotary encoder 96 (step S17 in the flowchart of FIG. 16).

Further, when the correction of the angular and lateral displacements of the sheet P by the pair of sheet holding rollers 31 (i.e., the secondary correction) is performed after the setting of the target conveyance timing, the conveyance rotation speed of the pair of sheet holding rollers 31 is changed based on the amount of correction of the angular and lateral displacements of the sheet P along the secondary correction. The amount of correction of the angular and lateral displacements of the sheet P corresponds to the drive position (i.e., the drive amount and the drive direction) in which the pair of sheet holding rollers 31 moves in the width direction or rotates within a plane of sheet conveyance when correcting the angular and lateral displacements of the sheet. Accordingly, in the present embodiment, the conveying speed controller 23 obtains the signal sent from the rotary encoder 57 that detects the drive amount and the driving direction in the width direction of the pair of sheet holding rollers 31 and information from the rotary encoder 58 that detects the drive amount and the driving direction within a plane of sheet conveyance of the pair of sheet holding rollers 31 (step S18 in the flowchart of FIG. 16).

Then, in step S14 in the flowchart of FIG. 16, the target rotation speed of the pair of sheet holding rollers 31 for conveyance of the sheet P is changed again based on the target conveyance timing and the signals from the rotary encoders 96, 57, and 58 (step S14 in the flowchart of FIG. 16). After step S14, based on the calculated target rotation speed of the pair of sheet holding rollers 31, the conveyance rotation speed of the pair of sheet holding rollers 31 is controlled again (step S15 in the flowchart of FIG. 16).

Then, the control of the conveyance rotation speed of the pair of sheet holding rollers 31 as described above is performed until the sheet conveyance time reaches the target conveyance timing (step S16 in the flowchart of FIG. 16). Then, after the sheet conveyance time has reached the target conveyance timing (YES in step S16 in the flowchart of FIG. 16), the sheet P is conveyed to the sheet gripping position A at the constant velocity equal to a conveyance rotation speed of the transfer cylinder 8 (step S19 in the flowchart of FIG. 16). As a result, the conveying speed of the sheet P can be changed according to the amount of correction of the angular and lateral displacements of the sheet P, and therefore the sheet P can be conveyed to the sheet gripping position A timely with high accuracy.

Figure 17:
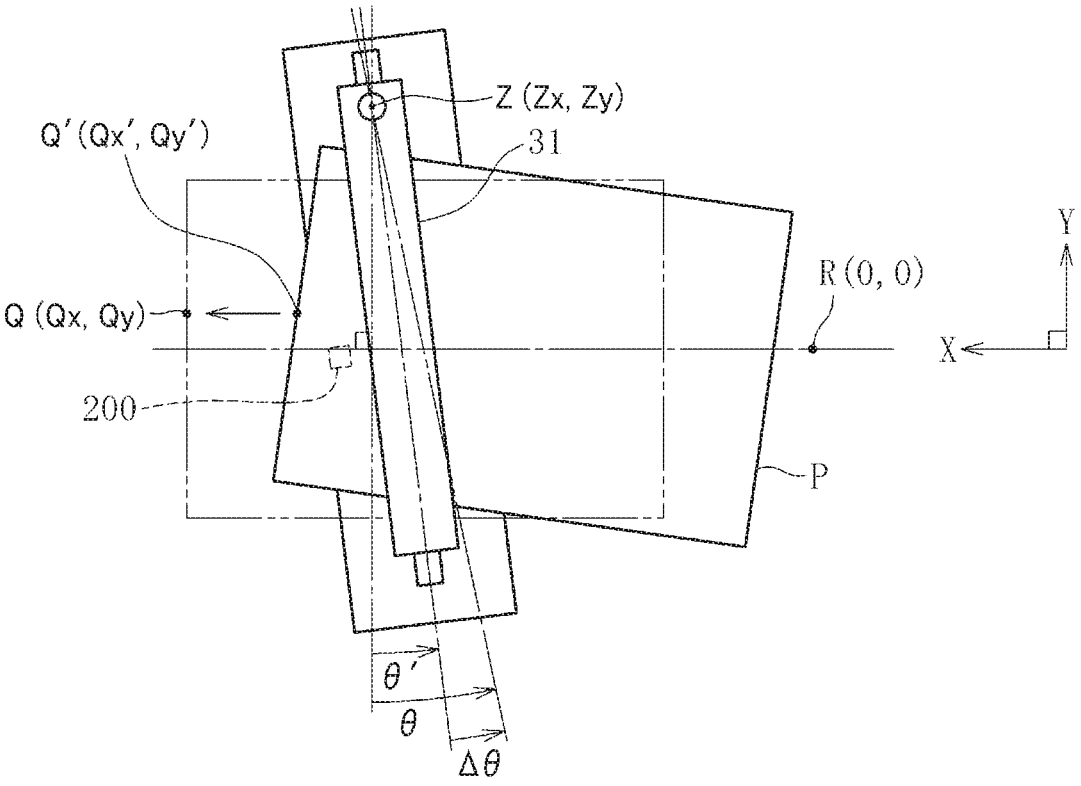
FIG. 17 is a diagram for explaining a method of calculating an amount of position change of a sheet according to correction of angular and lateral displacements.

Now, a description is given of a method of calculating the amount of position change of a sheet according to correction of the angular and lateral displacements of the sheet with reference to FIG. 17.

FIG. 17 is a diagram for explaining a method of calculating the amount of position change of a sheet according to correction of angular and lateral displacements of the sheet.

In FIG. 17, a point Z indicates a position of the rotation center (i.e., the support shaft 73) within a plane of sheet conveyance when the pair of sheet holding rollers 31 is located at the home position, a point R indicates a measurement reference point, a point Q indicates a position of the leading end of the sheet when a time t has elapsed after the downstream side leading end detection sensor 200 has detected the leading end of the sheet, and a point Q' indicates a position of the leading end of the sheet when the angular and lateral displacements of the sheet is corrected at a timing (i.e., a time t−1) which is one previous timing before the time t. Further, in FIG. 17, letters in parentheses indicate are respective X coordinates and Y coordinates of the points Z, Q and Q' relative to the point R that functions as the measurement reference point, where the sheet conveying direction is an X direction and a direction perpendicular to the sheet conveying direction is a Y direction. Further, a reference symbol "θ" indicates an angle of inclination of the pair of sheet holding rollers 31 from the home position (i.e., an angle of rotation within a plane of sheet conveyance of the sheet) when the leading end of the sheet reaches the position of the point Q, and a reference symbol "θ" indicates an angle of inclination of the pair of sheet holding rollers 31 from the home position (i.e., an angle of rotation of the pair of sheet holding rollers 31 within a plane of sheet conveyance) when the leading end of the sheet reaches the position of the point Q'. A reference symbol "(Δθ)" indicates the difference between the angle of inclination θ and the angle of inclination θ'.

As described above, in a case in which the position of the leading end of the sheet P changes along with the correction of angular and lateral displacements of the sheet P, the position coordinates (Qx, Qy) of a leading end position Q at the time t are calculated using the following equations, which are Equation 1 and Equation 2).

$$Qx=\cos(\Delta\theta)(Qx'-Zx)-\sin(\Delta\theta)(Qy'-Zy)+Zx+Xp \quad \text{Equation 1.}$$

$$Qy=\sin(\Delta\theta)(Qx'-Zx)+\cos(\Delta\theta)(Qy'-Zy)+Zy+Yp+Ys \quad \text{Equation 2.}$$

"Xp" in Equation 1 is an X direction component of a conveyance distance of the sheet P in which the sheet P is conveyed until the one previous timing (i.e., the time t−1) before the time t. "Yp" in Equation 2 is a Y direction component of the conveyance distance of the sheet P. When a conveyance distance of the sheet P in which the sheet P is conveyed by the pair of sheet holding rollers 31 until the time t−1 (that is, a conveyance distance of the sheet P in a direction perpendicular to the roller shaft) is indicated as "Fp", Xp and Yp are expressed by the following Equations 3 and 4. Further, "Ys" in Equation 2 is an amount of movement of the sheet P in the width direction from the point Q' to the point Q (i.e., an amount of movement in a Y direction).

$$Xp=\cos(\theta')Fp \quad \text{Equation 3.}$$

$$Yp=\sin(\theta')Fp \quad \text{Equation 4.}$$

Therefore, by using the above Equations 1 to 4, the position coordinates (Qx, Qy) of the leading position Q at the time t is calculated.

Then, by subtracting an X coordinate Vx of the sheet leading end position after the time t has elapsed without the correction of the angular and lateral displacements of the sheet, from the calculated X coordinate Qx, the position change amount G of the leading end of the sheet according to the correction of the angular and lateral displacements of the sheet is calculated (see Equation 5 below). Then, by adjusting the conveying speed of the sheet to the target position based on the position change amount G that is calculated as described above, the sheet is conveyed to the target position at a predetermined sheet conveyance timing.

$$G=Qx-Vx \quad \text{Equation 5.}$$

As described above, since the sheet conveying device according to the present embodiment of this disclosure includes a CIS or CISs to detect the position of the side end of a sheet as a position detector or occasionally a position sensor of a plurality of position sensors to detect the position of the sheet, the CIS(s) can detect the side end of the sheet repeatedly or for multiple times during the period of time in which the sheet is passing by the CIS(s), which is, for example, the correction of angular and lateral displacements of the sheet after the adjustment operation (i.e., the secondary correction). By employing the CIS(s) as described above, the position of the sheet can be detected repeatedly or for multiple times. Therefore, the angular and lateral displacements of the sheet that are continuously generated during the sheet conveyance can be detected, and therefore the correction of the angular and lateral displacements of the sheet can be performed with high accuracy. Further, even if the position of the sheet in the conveying direction changes along with the correction of the angular and lateral displacements of the sheet, each time the correction of the angular and lateral displacements of the sheet is performed, the conveying speed of the sheet is changed based on the correction amounts of the angular and lateral displacements of the sheet (that is, the amount of change of the sheet in the width direction and the amount of change of the sheet in the rotation direction within a plane of sheet conveyance). By so doing, the sheet is conveyed to the target position at a predetermined sheet conveyance timing. That is, not by collectively adjusting the position change of the sheet in the sheet conveying direction along with the multiple corrections of angular and lateral displacements of the sheet by one change of the conveying speed of the sheet but by adjusting the position change of the sheet in the sheet conveying direction each time the correction of angular and lateral displacements of the sheet is performed, the conveying speed of the sheet is adjusted with more time to spare. According to this configuration, the sheet is conveyed with accuracy to meet the target conveyance timing reliably. As a result, the positional deviation of the image to the sheet P is prevented with high accuracy, and therefore the print quality is enhanced. Further, when performing the duplex printing operation, the positional deviation of images to the front side and the rear side is corrected, and therefore a relative positional deviation of the image formed on the front face of the sheet P and the image formed on the back face of the sheet P is eliminated.

In the present embodiment, the correction of the angular and lateral displacements of the sheet and the change of the conveying speed of the sheet are performed each time the position of the sheet is detected. However, the method of correcting the displacements of the sheet and changing the conveying speed of the sheet is not limited thereto. For example, firstly the displacement of the sheet may be corrected based on some detection results (at least two times) of the position information of the sheet detected repeatedly or for multiple times, and then the conveying speed of the sheet may be changed. That is, the number of times to correct the angular and lateral displacements of the sheet and the number of times to change the conveying speed of the sheet may be less than the number of times to detect the position of the sheet.

In the present embodiment, the downstream side leading end detection sensor 200 is driven together (integrally) with the pair of sheet holding rollers 31 but the configuration of the downstream side leading end detection sensor 200 is not limited thereto. For example, the downstream side leading end detection sensor 200 may be driven separately from the pair of sheet holding rollers 31. However, in that case, the leading end detection position of the downstream side leading end detection sensor 200 may be different according to the degree of angular displacement of the sheet. Therefore, in a case in which the angular and lateral displacements of the sheet are corrected by the adjustment operation by the pair of sheet holding rollers 31 after the sheet leading end position is detected (i.e., the primary correction), the target conveyance timing varies according to the degree of movement of the adjustment operation (i.e., the degree of angular displacement amount of the sheet). Therefore, in order to address the influence of such operation of displacement correction (i.e., the primary correction), the sheet conveyance timing of the sheet is to be detected in a state in which adjustment operation is completed.

By contrast, in a case in which the downstream side leading end detection sensor 200 is driven together (integrally) with the pair of sheet holding rollers 31 as the present embodiment, the sheet can be detected each time while facing the downstream side leading end detection sensor 200 (each time the same posture). Consequently, the leading end detection position of the downstream side leading end detection sensor 200 may not vary according to the degree of angular displacement of the sheet. Therefore, the target conveyance timing may not be susceptible to the variation in the leading end detection position, in addition, the downstream side leading end detection sensor 200 is returned to the same position (i.e., the home position) each time along with the adjustment operation performed by the pair of sheet holding rollers 31. Therefore, the distance from the downstream side leading end detection sensor 200 to the target position B is the same distance each time. Accordingly, the target conveyance timing of the sheet is not susceptible to the change in the distance from the downstream side leading end detection sensor 200 to the target position B.

As described above, in the present embodiment, the downstream side leading end detection sensor 200 is driven together with the pair of sheet holding rollers 31. Therefore, there is no various adverse effects that are generated when the sensors are fixed, and therefore the conveying speed of the sheet according to the adjustment operation (i.e., the primary correction) may not be changed. Further, since the target conveying timing is not affected by the adjustment operation, the sheet conveyance timing of the sheet is detected before completion of the adjustment operation (in other words, before or during the adjustment operation). Therefore, the target conveyance timing can be set at an early stage, and sufficient control time of the conveying speed of the sheet to be performed later can be secured, and the accuracy in control is enhanced.

It is to be noted that, in the present embodiment, the downstream side leading end detection sensor 200 is disposed on the downstream side of the pair of sheet holding rollers 31. However, in order to obtain the effect by driving the downstream side leading end detection sensor 200 together with the pair of sheet holding rollers 31, the downstream side leading end detection sensor 200 may be disposed upstream from the pair of sheet holding rollers 31 in the sheet conveying direction.

Further, according to the present embodiment, the conveying speed of the sheet along with the adjustment operation may not need to be changed. Therefore, the conveying speed of the sheet may be changed corresponding to the correction of angular and lateral displacements of the sheet after the adjustment operation (i.e., the secondary correction). Moreover, the correction of angular and lateral displacements of the sheet after the adjustment operation (i.e., the secondary correction) is a fine correction of the displacements of the sheet to be performed after the angular and lateral displacements of the sheet have corrected once. Therefore, the change of the conveying speed of the sheet along with the correction of the displacements of the sheet (i.e., the secondary correction) is generally sufficient to be a fine change. Accordingly, even when the sheet is conveyed at high speed or even when the distance of conveyance of the sheet to the target position is short, the conveying speed of the sheet can be changed sufficiently.

Further, in the present embodiment, the correction amounts of angular and lateral displacements of the sheet are obtained indirectly from information of the rotary encoders 57 and 58 (that function as drive position detectors) that detect the amount of movement of the pair of sheet holding rollers 31 in the width direction and the amount of rotation of the pair of sheet holding rollers 31 within a plane of sheet conveyance (in other words, the magnitude that the pair of sheet holding rollers 31 adjusts the position of the sheet P). However, the correction amounts of angular and lateral displacements of the sheet may also be obtained by calculation based on the CIS(s) that directly detect the position of the sheet. However, the CIS (or the CISs) has a large amount of information and a large load such as communication and arithmetic processing. Therefore, the period from the time of detection of the position of the sheet to the time of the change of the conveying speed of the sheet may become longer. By contrast, when calculating the correction amount of angular and lateral displacements of the sheet indirectly based on the information from the rotary encoders (i.e., the rotary encoders 57 and 58), the amount of load such as communication and arithmetic processing is reduced. Therefore, the change of the conveying speed of the sheet is started at an earlier timing. Therefore, even in a configuration in which the conveying speed of the sheet is a relatively high speed or the distance of sheet conveyance to the target position is short, the control time of the conveying speed of the sheet is secured and the sheet is conveyed with high accuracy.

Figure 18:
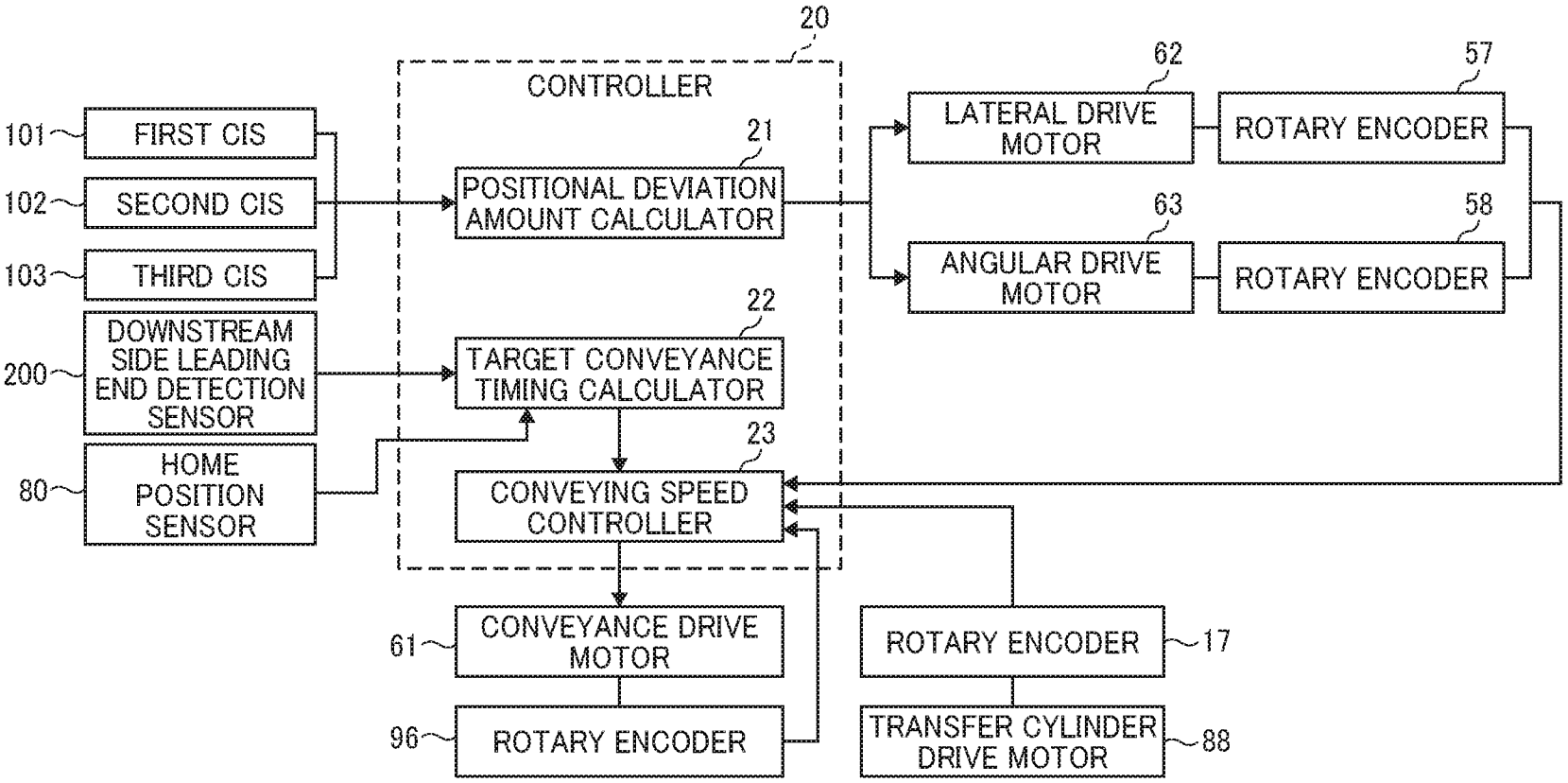
FIG. 18 is a block diagram illustrating a control system of a sheet conveying device according another embodiment of this disclosure.
Figure 19:
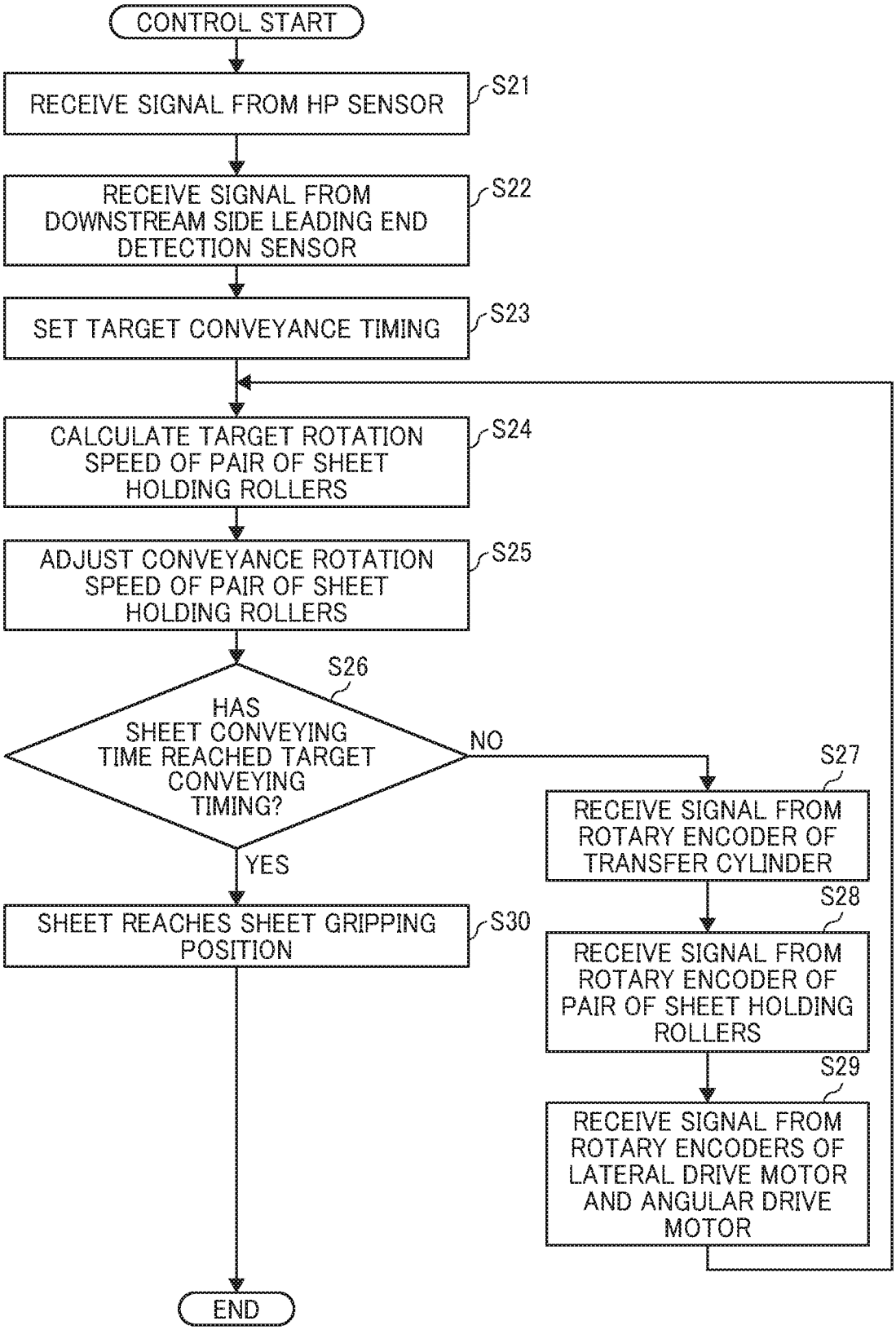
FIG. 19 is a flowchart of the sheet conveying device according to another embodiment of this disclosure.

Now, a description is given of the sheet conveying device 7 according to another embodiment of this disclosure with reference to FIGS. 18 and 19.

FIG. 18 is a block diagram illustrating a control system of the sheet conveying device 7 according another embodiment of this disclosure. FIG. 19 is a flowchart of the sheet conveying device 7 according to another embodiment of this disclosure.

The sheet conveying device 7 according to another embodiment illustrated in FIG. 18 basically has a configuration identical to the sheet conveying device 7 illustrated in FIG. 6. However, different from the sheet conveying device 7 illustrated in FIG. 6, the sheet conveying device 7 illustrated in FIG. 18 further includes a rotary encoder 17 that functions as a rotation speed detector to detect the conveyance rotation speed of the transfer cylinder 8 that is driven and rotated by a transfer cylinder drive motor 88. As illustrated in FIG. 19, the flowchart includes an additional process (i.e., step S27) in which the controller 20 receives a signal front the rotary encoder 17. Specifically, steps S21 through S26 in the flowchart of FIG. 19 perform the same processes as steps S11 through S16 in the flowchart of FIG. 16 and steps S28 through S30 in the flowchart of FIG. 19 perform the same processes as steps S17 through S19 in the flowchart of FIG. 16.

Basically, the transfer cylinder 8 is controlled to rotate at a constant velocity. However, it is also conceivable that the conveyance rotation speed of the transfer cylinder 8 changes for some reasons. In that case, as described above, even if the conveyance rotation speed of the pair of sheet holding rollers 31 is changed based on the amounts of the angular and lateral displacement corrections of the sheet P, the timing of conveyance of the sheet P and the timing of arrival of the gripper 16 on the transfer cylinder 8 may not meet.

Therefore, in the present embodiment, the conveying speed controller 23 obtains a signal from the rotary encoder 17 of the transfer cylinder 8 in addition to the signal from the rotary encoder 96 that detects the conveyance rotation speed of the pair of sheet holding rollers 31 and the signal from the respective rotary encoders 57 and 58 that detect the amount of movement of the pair of sheet holding rollers 31 in the width direction and the amount of rotation of the pair of sheet holding rollers 31 within a plane of sheet conveyance, respectively (in other words, the magnitude that the pair of sheet holding rollers 31 adjusts the position of the sheet P) (steps S27 through S29 in the flowchart of FIG. 19). Then, the controller 20 adjusts the conveyance rotation speed of the pair of sheet holding rollers 31 based on the signal from the rotary encoder 96 that detects the conveyance rotation speed of the pair of sheet holding rollers 31, the signal from the respective rotary encoders 57 and 58 that detect the amount of movement of the pair of sheet holding rollers 31 in the width direction and the amount of rotation of the pair of sheet holding rollers 31 within a plane of sheet conveyance (in other words, the magnitude that the pair of sheet holding rollers 31 adjusts the position of the sheet P), and the signal from the rotary encoder 17 of the transfer cylinder 8, respectively, and the target conveyance timing (step S24 in the flowchart of FIG. 19). Then, the controller 20 adjusts the conveyance rotation speed of the pair of sheet holding rollers 31 based on the target rotation speed calculated again (step S25 in the flowchart of FIG. 19). As a result, even if the conveyance rotation speed of the transfer cylinder 8 is changed, the timing of conveyance of the sheet P and the timing of arrival of the gripper 16 on the transfer cylinder 8 are matched, and therefore the sheet P is conveyed with higher accuracy.

Figure 20:
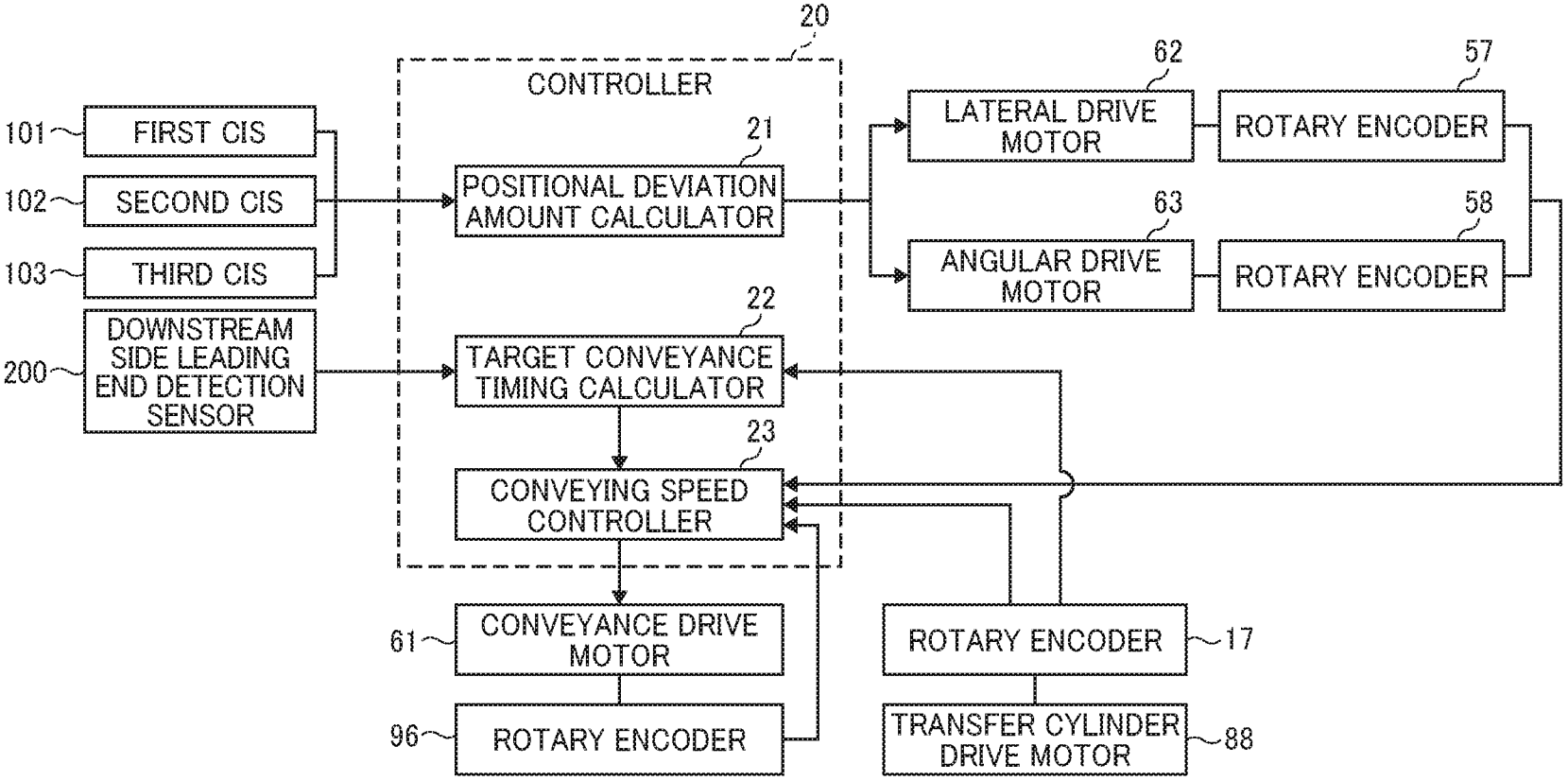
FIG. 20 is a block diagram illustrating a control system of a sheet conveying device according yet another embodiment of this disclosure.
Figure 21:
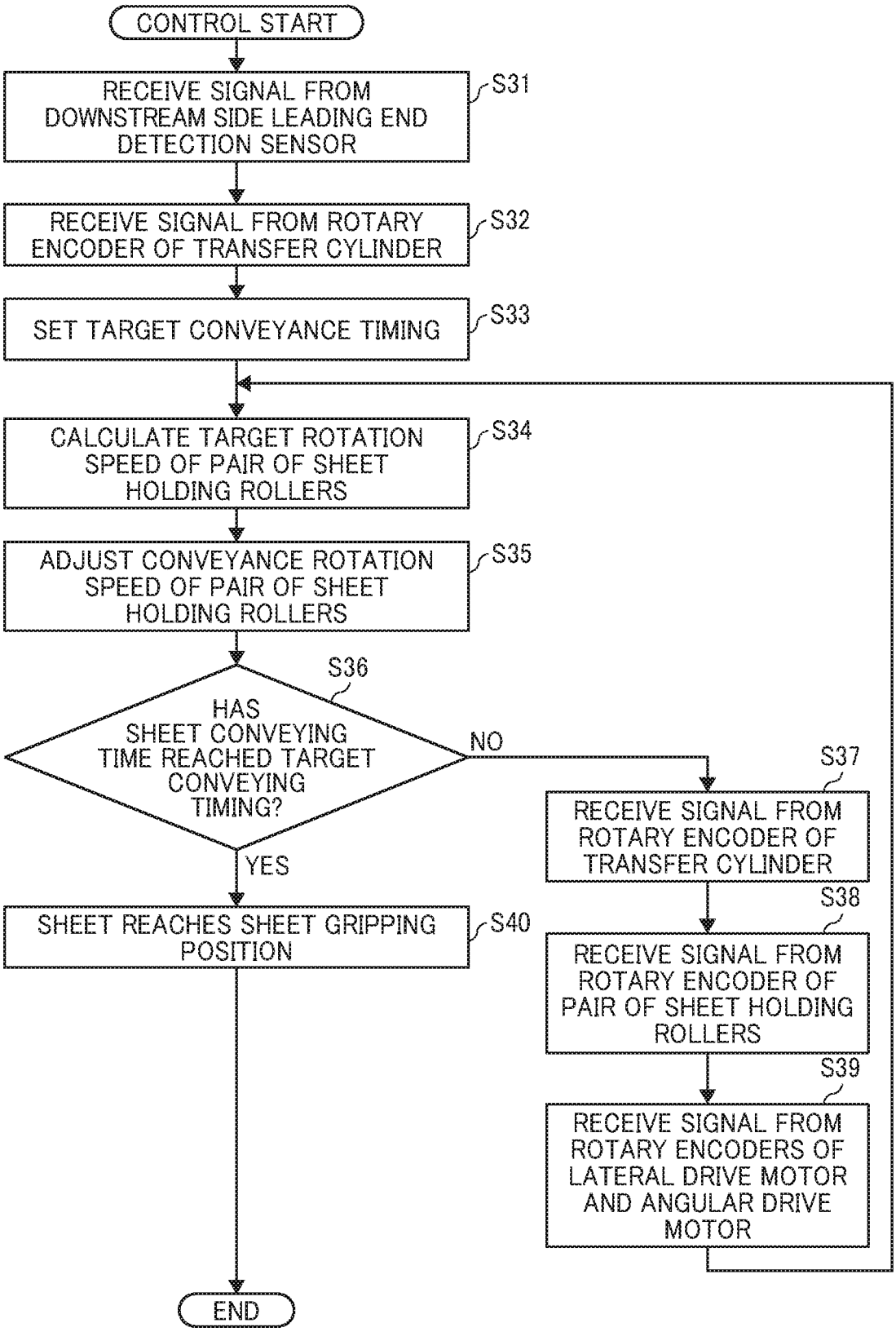
FIG. 21 is a flowchart of the sheet conveying device according to yet another embodiment of this disclosure.

Next, a description is given of the sheet conveying device 7 according to yet another embodiment of this disclosure with reference to FIGS. 20 and 21.

FIG. 20 is a block diagram illustrating a control system of the sheet conveying device 7 according yet another embodiment of this disclosure. FIG. 21 is a flowchart of the sheet conveying device 7 according to yet another embodiment of this disclosure.

The sheet conveying device 7 according to yet another embodiment illustrated in FIG. 20 basically has a configuration identical to the sheet conveying device 7 illustrated in FIG. 18. However, different from the sheet conveying device 7 illustrated in FIG. 18, the sheet conveying device 7 illustrated in FIG. 20 does not include the home position sensor 80 and receives the signal from the rotary encoder 17 of the transfer cylinder 8 instead of the signal from the home position sensor 80 (see step S32 in the flowchart of FIG. 21). Apart from the difference, the configuration of the sheet conveying device 7 illustrated in FIG. 20 and the flowchart of FIG. 21 are same as the configuration of the sheet conveying device 7 illustrated in FIG. 18 and the flowchart of FIG. 19, respectively. Specifically, step S31 in the flowchart of FIG. 21 performs the same processes as step S22 in the flowchart of FIG. 19, step S32 in the flowchart of FIG. 21 performs the same processes as step S27 in the flowchart of FIG. 19, and steps S33 through S40 in the flowchart of FIG. 21 perform the same processes as steps S23 through S30 in the flowchart of FIG. 19.

Even without receiving the signal from the home position sensor 80, the position of the gripper 16 is checked based on the signal sent from the rotary encoder 17 of the transfer cylinder 8. Therefore, in the present embodiment, by (based on) receiving the signal from the downstream side leading end detection sensor 200 (step S11 in the flowchart of FIG. 21) and then receiving the signal from the rotary encoder 17 of the transfer cylinder 8 (step S12 in the flowchart of FIG. 21), the target conveyance timing is set (step S13 in the flowchart of FIG. 21).

Figure 22:
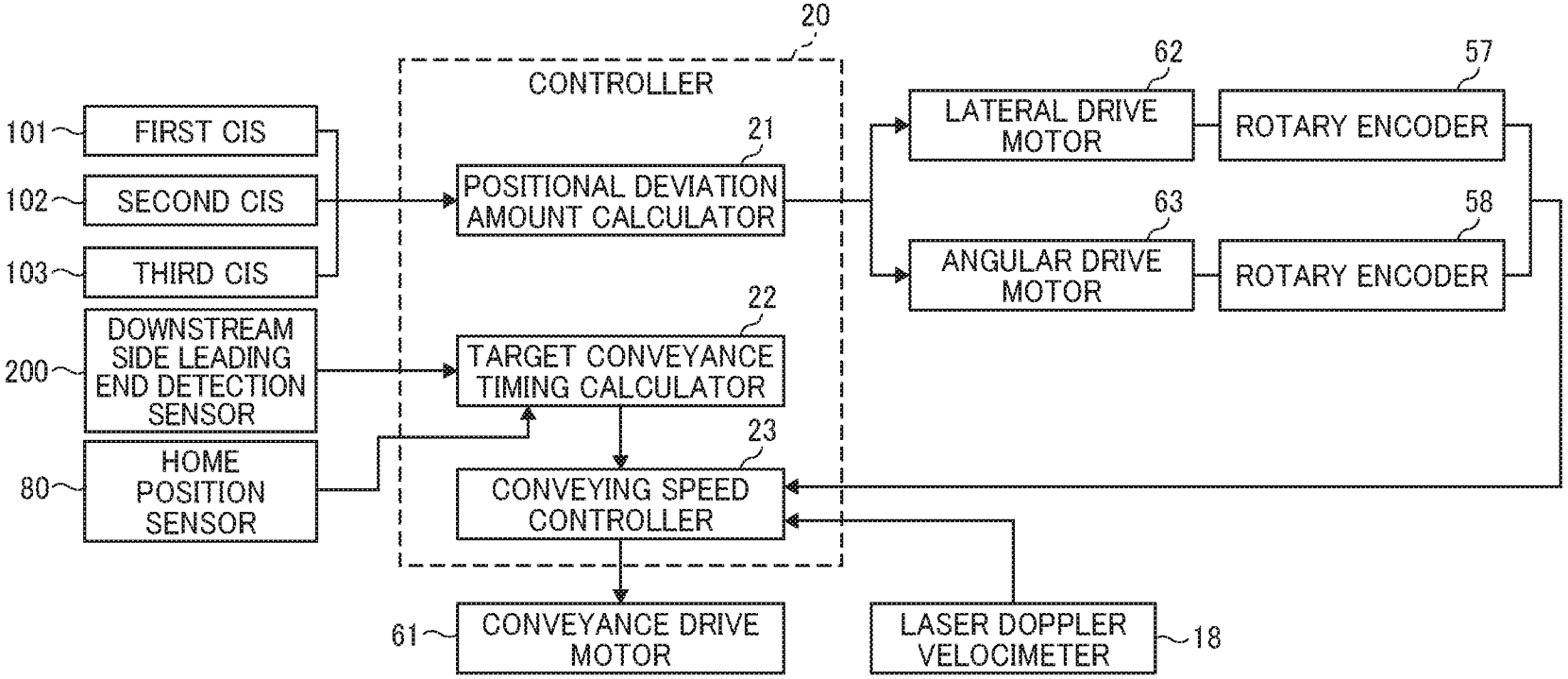
FIG. 22 is a block diagram illustrating a control system of a sheet conveying device according to yet another embodiment of this disclosure.
Figure 23:
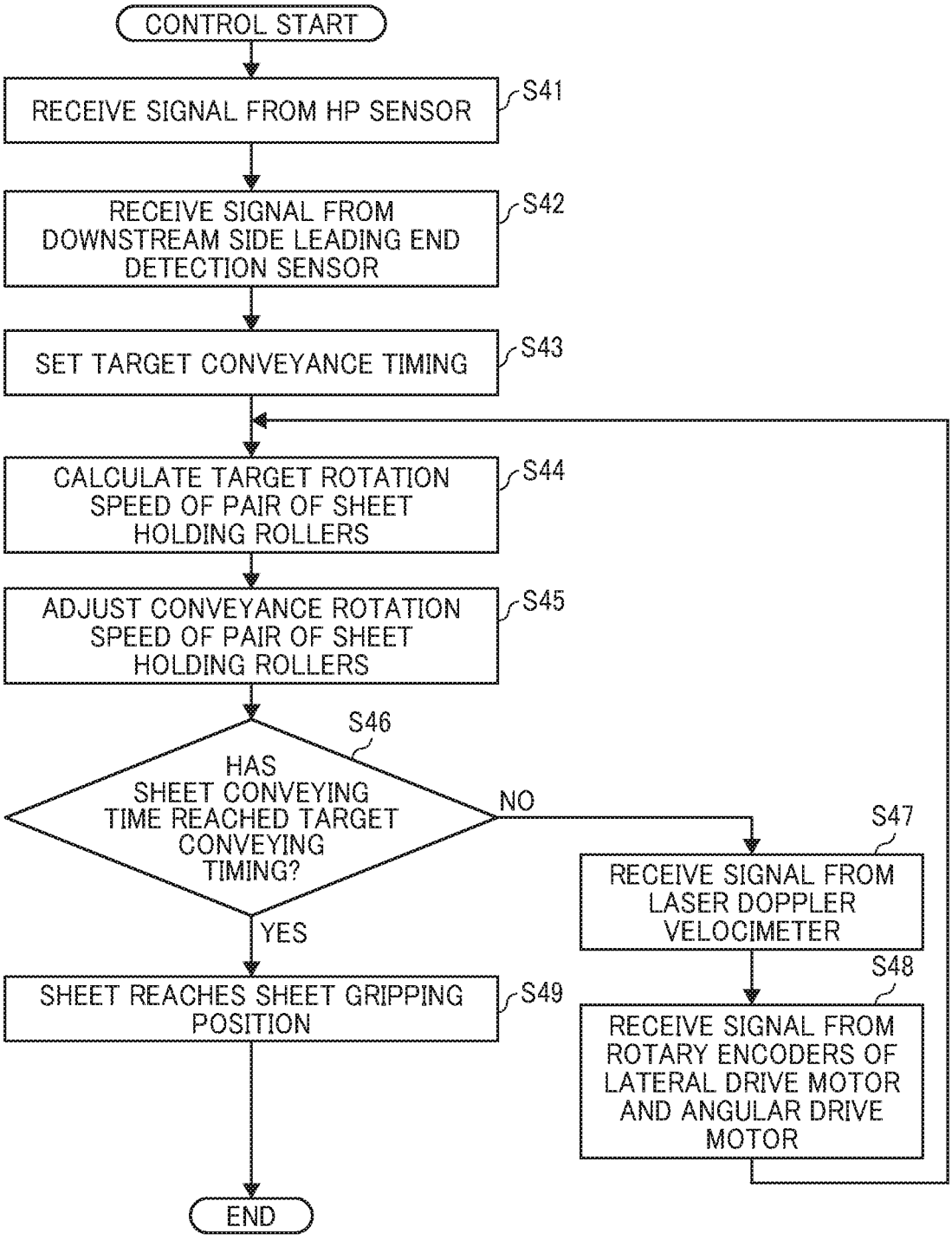
FIG. 23 is a flowchart of the sheet conveying device according to yet another embodiment of this disclosure.

Now, a description is given of the sheet conveying device 7 according to yet another embodiment of this disclosure with reference to FIGS. 22 and 23.

FIG. 22 is a block diagram illustrating a control system of the sheet conveying device 7 according yet another embodiment of this disclosure. FIG. 23 is a flowchart of the sheet conveying device 7 according to yet another embodiment of this disclosure.

The sheet conveying device 7 according to yet another embodiment illustrated in FIG. 22 basically has a configuration identical to the sheet conveying device 7 illustrated in FIG. 6. However, different from the sheet conveying device 7 illustrated in FIG. 6, the sheet conveying device 7 illustrated in FIG. 22 does not include the rotary encoder 96 and further includes a laser doppler velocimeter 18 that functions as a conveyance target medium speed detector to detect the conveyance speed of the sheet P. The laser doppler velocimeter 18 is a non-contact type measuring instrument that directly measures the conveying speed of a conveyance target medium (i.e., the sheet P) by utilizing the Doppler effect of light.

In the above-described embodiments, which are the sheet conveying device 7 illustrated in FIG. 6 and the sheet conveying device 7 illustrated in FIG. 18, a signal from the rotary encoder 96 that detects the conveyance rotation speed of the pair of sheet holding rollers 31 is obtained, so that the conveying speed of the sheet P is indirectly detected. However, in a case in which slippage occurs between the sheet P and the pair of sheet holding rollers 31, the conveyance rotation speed of the pair of sheet holding rollers 31 obtained by information from the rotary encoder 96 may not detect the conveying speed of the sheet P correctly.

Therefore, in the present embodiment, the sheet conveying device 7 according to this embodiment, the rotary encoder 96 that detects the conveyance rotation speed of the pair of sheet holding rollers 31 is replaced by the laser doppler velocimeter 18. By so doing, the conveyance rotation speed of the pair of sheet holding rollers 31 is controlled based on the conveying speed of the sheet P that is directly detected by the laser doppler velocimeter 18 (step S47 in FIG. 23). That is, basically, steps S41 through S46 in the flowchart of FIG. 23 perform the same processes as steps S21 through S26 in the flowchart of FIG. 19, and steps S48 and S49 in the flowchart of FIG. 23 perform the same processes as steps S29 and S30 in the flowchart of FIG. 19. Specifically, in the present embodiment, the conveying speed controller 23 obtains the signal from the respective rotary encoders 57 and 58 that detect the amount of movement of the pair of sheet holding rollers 31 in the width direction and the amount of rotation of the pair of sheet holding rollers 31 within a plane of sheet conveyance (in other words, the magnitude that the pair of sheet holding rollers 31 adjusts the position of the sheet P) and a signal sent from the laser doppler velocimeter 18 (steps S47 and S48 in the flowchart of FIG. 23). Then, the controller 20 adjusts the conveyance rotation speed of the pair of sheet holding rollers 31 based on the signal from the signal from the respective rotary encoders 57 and 58, the signal from the laser doppler velocimeter 18, and the target conveyance timing (step S44 in the flowchart of FIG. 23). Then, the controller 20 adjusts the conveyance rotation speed of the pair of sheet holding rollers 31 based on the target rotation speed calculated again (step S45 in the flowchart of FIG. 23). As a result, even if slippage occurs between the sheet P and the pair of sheet holding rollers 31, the deviation of the sheet conveyance timing due to the slippage is prevented, and therefore the sheet P is conveyed with higher accuracy.

It is to be noted that, in the example of the configuration including the laser doppler velocimeter 18 in the embodiment, the conveying speed of the sheet P may be changed based on the conveyance rotation speed of the transfer cylinder 8 detected by the rotary encoder 17, as the example of the configuration illustrated in FIGS. 18 and 19. In that case, the deviation of the sheet conveyance timing of the sheet P due to the fluctuation of the slippage between the sheet P and the pair of sheet holding rollers 31 is prevented in addition to preventing the deviation of the sheet conveyance timing of the sheet P due to the slippage between the sheet P and the pair of sheet holding rollers 31, the conveyance with higher accuracy can be achieved.

Although the embodiments of this disclosure have been described above, this disclosure is not limited to the above-described embodiments, and it is obvious that various modifications can be made without departing from the gist of this disclosure.

In the above-described embodiments, CISs are used as position detectors or occasionally a plurality of position sensors to detect the position of the side end of a sheet. However, the position detector (or the position sensor of the plurality of position sensors) is not limited to a CIS and may be any detector such as multiple photosensors disposed along the width direction of the sheet as long as the detector detects the side edge of a sheet.

Further, in the above-described embodiments, both the angular displacement and the lateral displacement of a sheet are corrected. However, the sheet conveying device 7 according to this disclosure may be applied when correcting either one of the angular displacement and the lateral displacement of the sheet. Even in the configuration in which the lateral displacement alone is corrected, when the sheet has the angular displacement, the timing at which the leading end of the sheet reaches the downstream side leading end detection sensor varies by correcting the lateral displacement of the sheet. Therefore, the sheet conveyance timing of the sheet to the target value also varies.

Further, in the above-described embodiments, the conveying speed of a sheet is adjusted by changing the conveyance rotation speed of the pair of sheet holding rollers 31. However, without changing the conveying rotation speed of the pair of sheet holding rollers 31, a pair of sheet conveying rollers may be added to adjust the conveying speed of the sheet on the downstream side of the pair of sheet holding rollers 31.

Further, in the above-described embodiments, the sheet conveying device according to this disclosure is applied to an inkjet type image forming apparatus but is not limited thereto. For example, the sheet conveying device according to this disclosure may also be applicable to an electrophotographic image forming apparatus.

Figure 24:
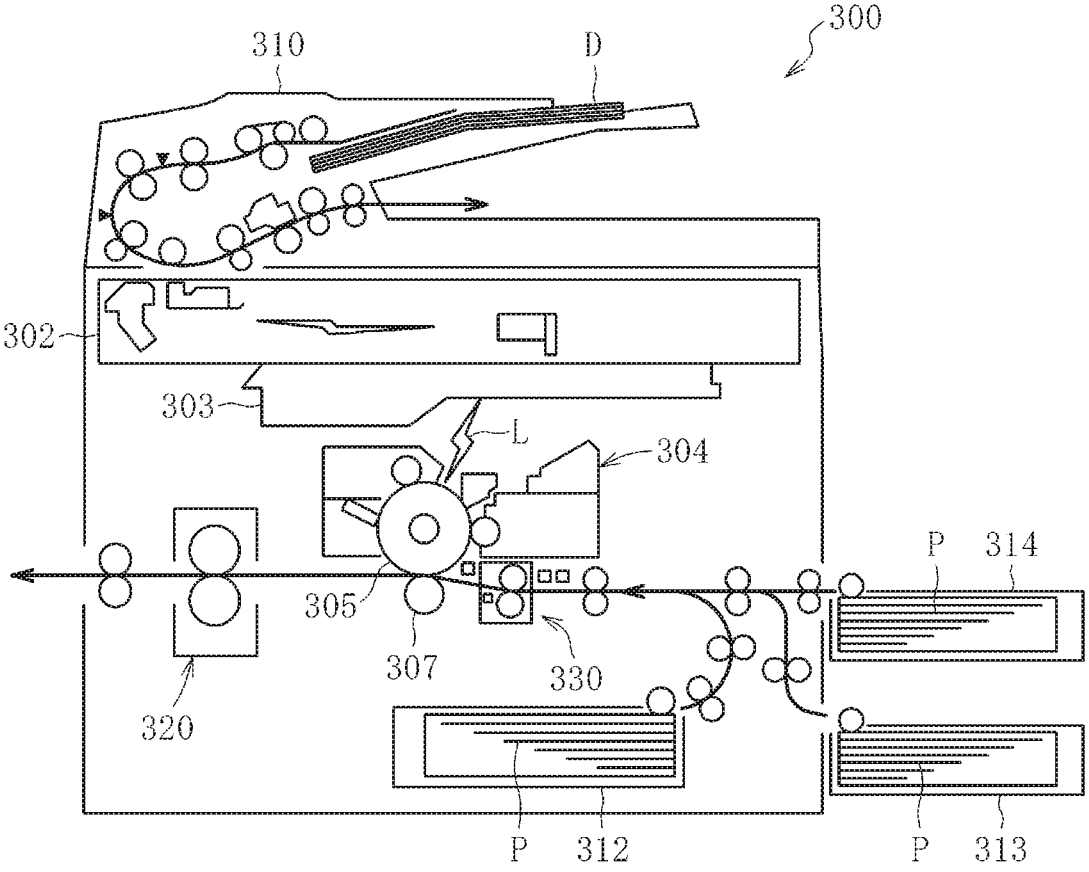
FIG. 24 is a diagram illustrating an electrophotographic image forming apparatus including the sheet conveying device according to the embodiments of this disclosure.

FIG. 24 is a diagram illustrating an electrophotographic image forming apparatus 300 including a sheet conveying device according to an embodiment of this disclosure.

In FIG. 24, the electrophotographic image forming apparatus 300 includes a document reading device 302, an exposure device 303, a developing device 304, a photoconductor drum 305, a transfer unit (in other words, an image forming device) 307, a document conveying device 310, a first sheet feed tray 312, a second sheet feed tray 313, a third sheet feed tray 314, a fixing device 320 and a sheet conveying device 330.

The document reading device 302 optically reads image data of an original document D. The exposure device 303 emits an exposure light L based on the image data read by the document reading device 302 to the photoconductor drum 305. The developing device 304 forms a toner image on the surface of the photoconductor drum 305. The transfer unit 307 transfers the toner image formed on the surface of the photoconductor drum 305 onto a sheet P. The document conveying device 310 functions as a document feeder that conveys the original document D set on a document tray or a document loader to the document reading device 302. Each of the first sheet feed tray 312, the second sheet feed tray 313 and the third sheet feed tray 314 contains the sheet P therein.

The fixing device 320 fixes an unfixed image formed on the sheet P to the sheet P by application of heat and pressure. The sheet conveying device 330 conveys the sheet P fed by any one of the first sheet feed tray 312, the second sheet feed tray 313 and the third sheet feed tray 314.

A description is given of the basic operations of the electrophotographic image forming apparatus 300.

When the document D is conveyed by the document conveying device 310 in the direction indicated by arrow in FIG. 24 and the image data of the document D is read by the document reading device 302, based on the image information, the exposure device 303 emits the exposure light L based on the image data to the charged surface of the photoconductor drum 305. Consequently, an electrostatic latent image is formed on the surface of the photoconductor drum 305. Subsequently, the developing device 304 supplies toner onto the electrostatic latent image formed on the photoconductor drum 305, so that the electrostatic latent image on the photoconductor drum 305 is developed into a toner image (visible image). The sheet P fed from any one of the first sheet feed tray 312, the second sheet feed tray 313 and the third sheet feed tray 314 is conveyed to the transfer unit 307 by the sheet conveying device 330, so that the toner image formed on the photoconductor drum 305 is transferred onto the sheet P. Thereafter, the sheet P is conveyed to the fixing device 320. After the toner image is fixed in the fixing device 320, the sheet P is discharged to the outside of the electrophotographic image forming apparatus 300.

In such an electrophotographic image forming apparatus 300, the conveying speed of the sheet P is to be adjusted such that the sheet P reaches the transfer unit 307 at a timing synchronized with movement of the toner image formed on the photoconductor drum 305. Therefore, by applying a sheet conveying device conveying device similar to the above-described embodiment as the sheet conveying device 330 that conveys the sheet P to the transfer unit 307, the sheet conveyance timing of the sheet P is controlled with high accuracy while the positional deviation of the sheet P is corrected, so as to convey the sheet P to the transfer unit 307.

Further, the sheet conveying device according to this disclosure is also applicable to a post processing device that performs stapling and folding to the sheet after an image has been transferred onto the sheet.

Figure 25:
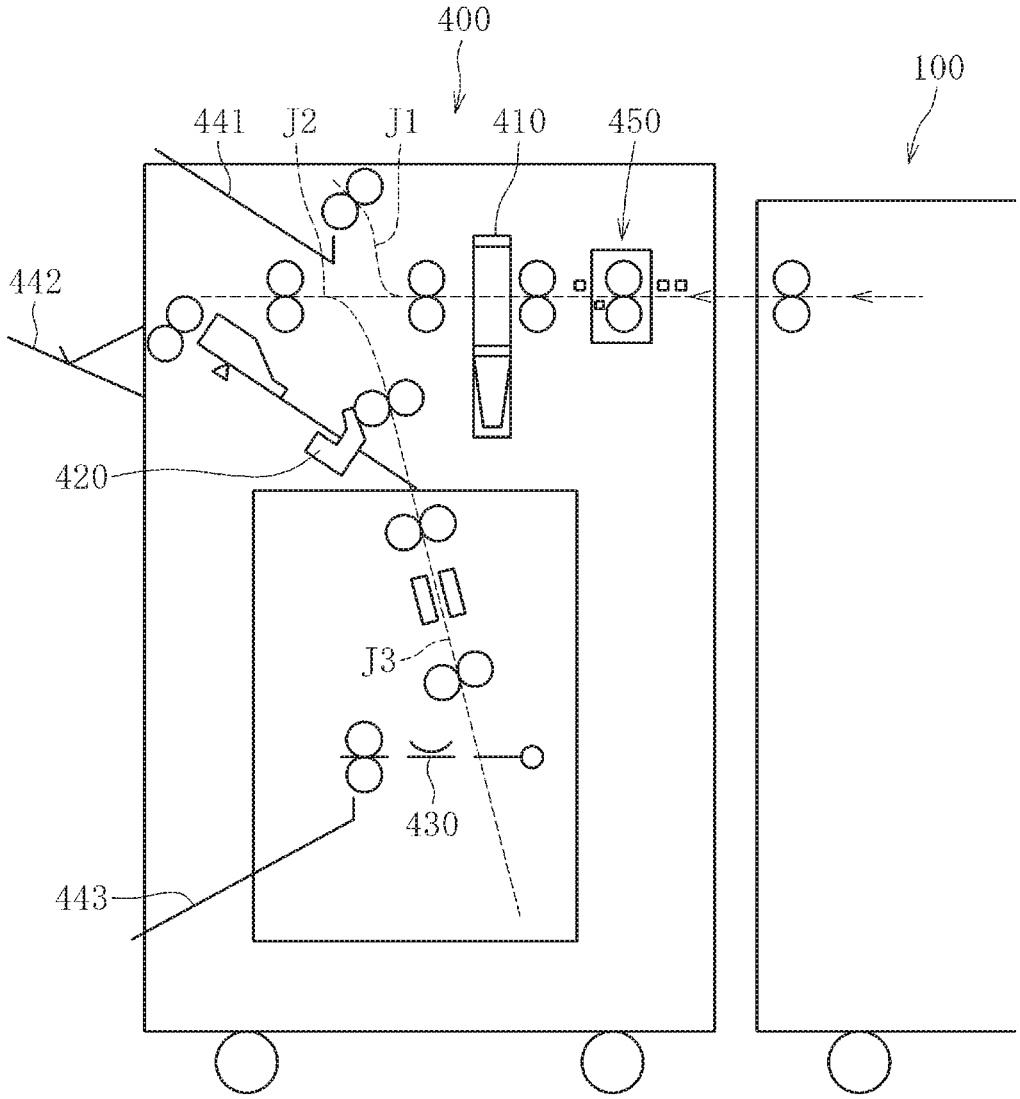
FIG. 25 is a schematic diagram illustrating an entire configuration of a post processing device.

Now, a description is given of a post processing device 400 to which this disclosure is applied, with reference to FIG. 25.

FIG. 25 is a schematic diagram illustrating an entire configuration of the post processing device 400.

The post processing device 400 illustrated in FIG. 23 includes a punching device 410, a stapling device 420, a sheet folding device 430, multiple sheet trays, specifically, a first sheet tray 441, a second sheet tray 442 and a third sheet tray 443, and a sheet conveying device 450.

The punching device 410 performs a punching process to a sheet. The stapling device 420 performs a binding process to the sheet. The sheet folding device 430 performs a center folding process. The first sheet tray 441, the second sheet tray 442, and the third sheet tray 443 function as multiple sheet loaders. The sheet conveying device 450 conveys the sheet from the image forming apparatus 100 to the punching device 410.

Further, the post processing device 400 performs different post processing processes by conveying the sheet conveyed from the image forming apparatus 100 to any one of three sheet conveyance passages, which are a first sheet conveyance passage J1, a second sheet conveyance passage J2 and a third sheet conveyance passage J3.

The first sheet conveyance passage J1 is a sheet conveyance passage to convey the sheet P to the first sheet tray 441 after the punching process is performed by the punching device 410 or without the punching process. The second sheet conveyance passage J2 is a sheet conveyance passage to convey the sheet P to the second sheet tray 442 after the stapling process is performed by the stapling device 420. The third sheet conveyance passage J3 is a sheet conveyance passage to convey the sheet P to the third sheet tray 443 after the center folding process is performed by the sheet folding device 430.

By applying a sheet conveying device similar to the sheet conveying device according to the above-described embodiments as the sheet conveying device 450 provided to the post processing device 400, the sheet is conveyed at a predetermined timing while the positional deviation of the sheet is being corrected. Therefore, the punching process, the accuracy of the binding process or the center folding process to be performed when the sheet is conveyed is enhanced.

Further, the sheet conveying device according to this disclosure is not limited to a sheet conveying device to convey sheets. The sheet conveying device according to this disclosure can be applied to a sheet conveying device that conveys recording media such as overhead projector (OHP)

sheets and OHP films on which an image is formed or sheets such as original documents, as well as sheets including plain papers, thick papers, thin papers, coated papers, label papers and envelopes. Further, the sheet conveying device according to this disclosure can be employed to not only a sheet conveying device that conveys a recording median and a sheet such as an original document, but also a sheet conveying device that conveys a conveyance target medium such as a printed circuit board.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a position detector including at least one sensor configured to detect a position of a side end of a conveyance target medium;

a position adjuster including a pair of rollers configured to hold and convey the conveyance target medium, and corresponding driving motors configured to adjust a position of the conveyance target meduim by (i) moving the pair of rollers in a width direction of the conveyance target medium and (ii) rotating the pair of rollers in a rotation direction around a shaft; and a controller including a processor configured to, while the conveyance target medium is being conveyed by the pair of rollers, perform multiple times an operation of changing a conveying speed of the conveyance target medium while the conveyance target medium is being conveyed according to an amount of a change of the position of the conveyance target medium.

2. The sheet conveying device according to claim 1, wherein the position detector is configured to repeatedly detect the position of the side end of the conveyance target medium.

3. The sheet conveying device according to claim 1, wherein the controller is configured to repeatedly change the conveying speed of the conveyance target medium, according to the change of the position of the conveyance target medium after adjustment by the position adjuster.

4. The sheet conveying device according to claim 1, further comprising:

a drive position detector including an encoder configured to detect a drive position of the position adjuster in at least one of the width direction of the conveyance target medium and the rotation direction, wherein the processor is configured to change the conveying speed of the conveyance target medium based on a detection of the drive position detected by the drive position detector.

5. The sheet conveying device according to claim 1, further comprising:

a conveyance rotary body having an outer circumferential surface on which a handle configured to grip the conveyance target medium is mounted, wherein the controller is configured to change the conveying speed of the conveyance target medium based on a magnitude that the position adjuster adjusts the position of the conveyance target medium to convey the conveyance target medium to the conveyance rotary body at a time when the handle grips the conveyance target medium.

6. The sheet conveying device according to claim 5, further comprising:

a rotation speed detector including an encoder configured to detect a conveyance rotation speed of the conveyance rotary body, wherein the controller is configured to change the conveying speed of the conveyance target medium based on the magnitude that the position adjuster adjusts the position of the conveyance target medium and the conveyance rotation speed detected by the rotation speed detector.

7. The sheet conveying device according to claim 6, wherein the conveyance rotary body is disposed downstream from the pair of rollers in a sheet conveyance direction.

8. The sheet conveying device according to claim 1, further comprising:

a conveyance target medium speed detector configured to directly detect the conveying speed of the conveyance target medium, wherein the controller is configured to change the conveying speed of the conveyance target medium based on a magnitude that the position adjuster adjusts the position of the conveyance target medium and the conveying speed detected by the conveyance target medium speed detector.

9. The sheet conveying device according to claim 1, wherein a number of times the position adjuster repeatedly adjusts the position of the conveyance target medium and a number of times the controller changes the conveying speed of the conveyance target medium are less than a number of times the position detector detects the position of the side end of the conveyance target medium.

10. An image forming apparatus comprising:

the sheet conveying device according to claim 1.

11. The sheet conveying device according to claim 1, wherein the processor is configured to change the conveying speed according to the amount of the change of the position of the conveyance target medium after the conveyance target medium is adjusted by the position adjuster.

12. The sheet conveying device according to claim 1, further comprising:

a conveyance rotary body having an outer circumferential surface on which a handle configured to grip the conveyance target medium is mounted, wherein the controller is configured to change the conveying speed of the conveyance target medium while the conveyance target medium is being conveyed by the pair of rollers to the handle.

13. The sheet conveying device according to claim 1, further comprising:

a second conveyance rotary body to hold and convey the conveyance target medium conveyed by the conveyance rotary body; and an ink discharging device to discharge ink toward the conveyance target medium held by the second conveyance rotary body.

14. The sheet conveying device according to claim 1, wherein the processor is configured to, while the conveyance target medium is being conveyed by the pair of rollers, perform multiple times, an operation of receiving, from the position detector, updates on the position of the side end of the conveyance target medium, an operation of instructing, based on the updates on the position of the side end of the conveyance target medium, the driving motors to perform the (i) moving the position adjuster in the width direction and (ii) rotating the pair of rollers in the rotation direction around the shaft to adjust the position of the conveyance target medium while the conveyance target medium is being conveyed, and the operation of changing the conveying speed of the conveyance target medium while the conveyance target medium is being conveyed according to the amount of the change of the position of the conveyance target medium.

15. A sheet conveying device comprising:

a position adjuster including a pair of rollers configured to hold and convey a conveyance target medium, and corresponding driving motors configured to adjust a position of the conveyance target medium by (i) moving the pair of rollers in a width direction of the conveyance target medium and (ii) rotating the pair of rollers in a rotation direction around the shaft;

a plurality of position sensors each including at least one sensor configured to detect a position of a side end of the conveyance target medium, the plurality of position sensors including a downstream sensor downstream from the pair of rollers and an upstream sensor upstream from the pair of rollers; and a controller including a processor configured to, while the conveyance target medium is being conveyed by the pair of rollers, repeatedly performing, multiple times an operation of changing a conveying speed of the conveyance target medium while the conveyance target medium is being conveyed, according to an amount of a change of the position of the conveyance target medium.

16. The sheet conveying device according to claim 15, wherein the plurality of position sensors are configured to repeatedly detect the position of the side end of the conveyance target medium.

17. The sheet conveying device according to claim 15, wherein the controller is configured to repeatedly change the conveying speed of the conveyance target medium, according to the change of the position of the conveyance target medium after adjustment by the position adjuster.

18. An image forming apparatus comprising the sheet conveying device according to claim 15.

19. The sheet conveying device according to claim 15, wherein the processor is configured to change the conveying speed according to the amount of the change of the position of the conveyance target medium after the conveyance target medium is adjusted by the position adjuster.

20. The sheet conveying device according to claim 15, wherein the processor is configured to, while the conveyance target medium is being conveyed by the pair of rollers, repeatedly perform multiple times, an operation of receiving, from a position detector, updates on the position of the side end of the conveyance target medium, an operation of instructing, based on the updates on the position of the side end of the conveyance target medium, the driving motors to perform the (i) moving the position adjuster in the width direction and (ii) rotating the pair of rollers in the rotation direction around the shaft to adjust the position of the conveyance target medium while the conveyance target medium is being conveyed, and the operation of changing the conveying speed of the conveyance target medium while the conveyance target medium is being conveyed according to the amount of the change of the position of the conveyance target medium.

21. A method of conveying a conveyance target medium via a position adjuster including a pair of rollers, the method comprising:

adjusting a position of the conveyance target medium by (i) moving the conveyance target medium in a width direction of the conveyance target medium and (ii) rotating the pair of rollers in a rotation direction; and repeatedly performing, while the conveyance target medium is being conveyed by the pair of rollers, multiple times, an operation of changing a conveying speed of the conveyance target medium according to an amount of a change of the position of the conveyance target medium.

22. The method of conveying according to claim 21, wherein the operation of changing the conveying speed includes repeatedly changing the conveying speed of the conveyance target medium, according to the change of the position of the conveyance target medium adjusted by the position adjuster.

23. The method of conveying according to claim 21, wherein the method further comprises:

instructing driving motors to repeatedly adjust the position of the conveyance target medium, while the conveyance target medium is being conveyed.

24. The method of conveying according to claim 23, further comprising:

detecting a drive position of a pair of rollers in at least one of the width direction of the conveyance target medium and the rotation direction, wherein the operation of changing the conveying speed includes changing the conveying speed of the conveyance target medium based on the drive position detected by the detecting the drive position.

25. The method of conveying according to claim 23, further comprising:

gripping the conveyance target medium conveyed by a pair of rollers, wherein the operation of changing the conveying speed includes:

changing the conveying speed of the conveyance target medium according to the change of the position of the conveyance target medium adjusted by the position adjuster; and conveying the conveyance target medium to a conveyance rotary body at the gripping.

26. The method of conveying according to claim 25, wherein the operation of changing the conveying speed includes changing the conveying speed of the conveyance target medium based on a magnitude the position adjuster adjusts the position of the conveyance target medium and a conveyance rotation speed of the conveyance rotary body.

27. The method of conveying according to claim 21, further comprising:

directly detecting the conveying speed of the conveyance target medium, wherein the operation of changing the conveying speed includes changing the conveying speed of the conveyance target medium based on a magnitude the position adjuster adjusts the position of the conveyance target medium and the conveying speed detected by the detecting.

28. The method of conveying according to claim 21, wherein a number of times of repeatedly adjusting the position of the conveyance target medium and a number of times of changing the conveying speed of the conveyance target medium are less than a number of times of detecting the position of the side end of the conveyance target medium.

29. A method of forming an image comprising:

the method of conveying a conveyance target medium according to claim 21 to convey the conveyance target medium; and forming an image on the conveyance target medium.

30. The method of conveying according to claim 21, wherein the repeatedly performing includes, while the conveyance target medium is being conveyed by the pair of rollers, repeatedly performing multiple times, an operation of receiving, from a position detector, updates on the position of the side end of the conveyance target medium, an operation of instructing, based on the updates on the position of the side end of the conveyance target medium, driving motors to perform the (i) moving the position adjuster in a width direction and (ii) rotating the pair of rollers in a rotation direction around a shaft to adjust the position of the conveyance target medium while the conveyance target medium is being conveyed, and the operation of changing the conveying speed of the conveyance target medium while the conveyance target medium is being conveyed according to the amount of the change of the position of the conveyance target medium.

* * * * *